US009387566B2

(12) United States Patent
Roeck et al.

(10) Patent No.: US 9,387,566 B2
(45) Date of Patent: Jul. 12, 2016

(54) HANDHELD ABRADING MACHINE

(71) Applicant: FLEX-ELEKTROWERKZEUGE GMBH, Steinheim/Murr (DE)

(72) Inventors: Dirk Roeck, Ingersheim (DE); Udo Panzer, Weissach (DE)

(73) Assignee: Flex-Elektrowerkzeuge GmbH, Steinheim/Murr (DE)

( * ) Notice: Subject to any disclaimer, the term of this patent is extended or adjusted under 35 U.S.C. 154(b) by 0 days.

(21) Appl. No.: 14/705,572

(22) Filed: May 6, 2015

(65) Prior Publication Data

US 2015/0231756 A1 Aug. 20, 2015

Related U.S. Application Data

(63) Continuation of application No. PCT/EP2013/075541, filed on Dec. 4, 2013.

(30) Foreign Application Priority Data

Dec. 7, 2012 (DE) ..... 10 2012 111 987

(51) Int. Cl.

| | |
|---|---|
| ***B24B 3/02*** | (2006.01) |
| ***B24B 23/02*** | (2006.01) |
| ***B24B 55/10*** | (2006.01) |
| ***B24B 55/05*** | (2006.01) |

(52) U.S. Cl.

CPC ..... *B24B 23/02* (2013.01); *B24B 55/052* (2013.01); *B24B 55/102* (2013.01)

(58) Field of Classification Search

CPC ..... B24B 7/182; B24B 7/184; B24B 23/02; B24B 47/12; B24B 55/04; B24B 55/05; B24B 55/052; B24B 55/055; B24B 55/06; B24B 55/10; B24B 55/102; B24B 55/105; B24B 55/107

See application file for complete search history.

(56) References Cited

U.S. PATENT DOCUMENTS

| | | | | |
|---|---|---|---|---|
| 3,826,045 | A * | 7/1974 | Champayne | B24B 55/102 451/359 |
| 3,882,644 | A * | 5/1975 | Cusumano | A47L 11/20 451/359 |
| 4,782,632 | A | 11/1988 | Matechuk | |
| 5,239,783 | A * | 8/1993 | Matechuk | B24B 7/184 451/354 |

(Continued)

FOREIGN PATENT DOCUMENTS

| | | |
|---|---|---|
| DE | 10 2008 059 585 | 7/2010 |
| EP | 1 719 581 | 11/2006 |

(Continued)

*Primary Examiner* — Timothy V Eley

(74) *Attorney, Agent, or Firm* — Womble Carlyle Sandridge & Rice LLP

(57) ABSTRACT

A handheld abrading machine is provided, including a holding device which includes a substantially tubular bar having a proximal end and a distal end and having a drive motor arranged at the proximal end and a tool head arranged at the distal end, and a transmission shaft connecting the drive motor to a tool holder of the tool head and running within at least sections of the tubular bar. The tool head includes a hood device which includes a hood element having a substantially cylindrical hood chamber, wherein the tool holder together with a tool arranged thereon is arrangeable in at least sections of the hood chamber. The hood element includes a recess in the form of a segment of a cylinder so that a tangent touching an edge of the tool runs substantially in a plane delimiting the recess in the form of a segment of a cylinder.

13 Claims, 27 Drawing Sheets

(56) References Cited

U.S. PATENT DOCUMENTS

| | | | | |
|---|---|---|---|---|
| 5,690,545 | A * | 11/1997 | Clowers | B24B 7/184 15/28 |
| 6,471,574 | B1 * | 10/2002 | Rupprecht | B24B 23/02 451/45 |
| 7,828,631 | B1 | 11/2010 | Herbert | |
| 7,887,395 | B2 * | 2/2011 | Weiford | B24B 7/184 451/354 |
| 8,206,200 | B2 | 6/2012 | Stott | |
| 8,523,635 | B2 * | 9/2013 | Manuel | B24B 5/366 241/DIG. 31 |
| 2006/0073778 | A1 | 4/2006 | Phillips et al. | |
| 2008/0085664 | A1 | 4/2008 | Weiford et al. | |
| 2009/0247059 | A1 | 10/2009 | Kammerer | |
| 2014/0329447 | A1 * | 11/2014 | Copeland | B24B 23/028 451/451 |
| 2015/0231755 | A1 * | 8/2015 | Roeck | B24B 23/02 451/177 |
| 2015/0314413 | A1 * | 11/2015 | Roeck | B24B 47/12 451/344 |

FOREIGN PATENT DOCUMENTS

| | | |
|---|---|---|
| EP | 1 834 732 | 9/2007 |
| EP | 2 163 356 | 3/2010 |
| EP | 2 196 284 | 6/2010 |

* cited by examiner

HANDHELD ABRADING MACHINE

CROSS-REFERENCE TO RELATED APPLICATIONS

This application is a continuation of International Application No. PCT/EP2013/075541, filed on Dec. 4, 2013, and claims the benefit of German Application No. 10 2012 111 987.2, filed on Dec. 7, 2012, which are incorporated herein by reference in their entirety and for all purposes.

FIELD OF DISCLOSURE

The present invention relates to a handheld abrading machine which comprises a holding device for holding the abrading machine, a drive motor and a tool head. The holding device comprises a substantially tubular bar which has a proximal end and a distal end, wherein the drive motor is arranged at the proximal end and wherein the tool head is arranged at the distal end. Furthermore, the handheld abrading machine comprises a transmission shaft which connects the drive motor to a tool holder of the tool head for transmitting torque thereto and which, at least in sections thereof, runs within the tubular bar.

BACKGROUND

A handheld abrading machine is known from DE 10 2005 021 153 A1, for example.

SUMMARY OF THE INVENTION

The object of the present invention is to provide a handheld abrading machine which allows the abrasion process to be simple, efficient and as fatigue-free as possible.

This object is achieved by a handheld abrading machine in accordance with claim 1.

In one embodiment of the invention, provision is made for the abrading machine to comprise a suction device which comprises a suction channel having a substantially ring-shaped or ring-section-shaped suction channel section.

A ring-section-shaped suction channel section is to be understood, in particular, as a section of a suction channel having a shape which corresponds at least approximately to a section of a ring, a segment of a ring or a sector of a ring.

It can be advantageous if the substantially ring-shaped or ring-section-shaped suction channel section surrounds a coupling device for coupling the transmission shaft to the tool holder at least in sections thereof.

The ring-shaped or ring-section-shaped suction channel section is preferably a suction channel section which is arranged downstream of the tool holder, and in particular directly after the tool holder with respect to the direction of suction.

In particular, provision may be made for an axis of symmetry of the substantially ring-shaped or ring-section-shaped suction channel section to correspond at least approximately to a rotational axis of an end of the transmission shaft towards the tool holder.

An axis of symmetry of a substantially ring-section-shaped suction channel section is preferably an axis of symmetry of a complete ring which is obtained by completion of the ring-section-shaped suction channel section.

Preferably, constant suction in the region of the tool holder and in particular constant suction of abraded material from the abrading process can be achieved by means of a substantially ring-shaped or ring-section-shaped suction channel section which surrounds the coupling device for coupling the transmission shaft to the tool holder at least in sections thereof.

It can be expedient if the tool holder and an end of the transmission shaft towards the tool holder, at least approximately, have a common rotational axis.

The tool holder and an end of the transmission shaft towards the tool holder are preferably connected to one another by means of one or more gear units and in particular, by means of one or more reduction gears.

The substantially ring-shaped or ring-section-shaped suction channel section preferably surrounds the coupling device and in particular, a gear unit for coupling the transmission shaft to the tool holder at least in sections thereof and at least approximately concentrically.

In one embodiment of the invention, provision is made for the tool holder and an end of the transmission shaft towards the tool holder to be connected to one another by means of a planetary gear.

In particular, provision may be made for the coupling device for coupling the transmission shaft to the tool holder to comprise a planetary gear or be formed by a planetary gear.

In particular, a planetary gear is to be understood as being an epicyclic gear which, in addition to shafts fixed to a frame, also possesses shafts which orbit along circular paths in a frame. The wheels rotating on the revolving shafts themselves circle a central wheel in similar manner to the planets circling the sun.

Preferably, a drive shaft of the coupling device is aligned with an output shaft of the coupling device.

In one embodiment of the invention, provision is made for the substantially ring-shaped or ring-section-shaped suction channel section of the suction channel of the suction device, the tool holder, an end of the transmission shaft towards the tool holder, and/or a hood device for covering the tool holder to be arranged such that they are substantially mutually coaxial.

Preferably, the substantially ring-shaped or ring-section-shaped suction channel section of the suction channel of the suction device, the tool holder, an end of the transmission shaft towards the tool holder and/or a hood device for covering the tool holder are pivotal together relative to the holding device about one or more pivotal axes by means of a swivel device.

The transmission shaft is preferably flexible at least in sections thereof.

The tool head is preferably connected to the holding device such as to be pivotal about one or more pivotal axes.

In particular, the tool head is connected to the holding device such as to be pivotal about one or more pivotal axes by means of a swivel device.

It can be advantageous if an end of the transmission shaft towards the tool holder is pivotal together with the tool head about one or more pivotal axes, and in particular, is pivotal about one or more pivotal axes by means of the swivel device.

In particular, provision may be made for an end of the transmission shaft towards the tool holder and the tool holder to have a common rotational axis in each pivotal position.

In one embodiment of the invention, provision is made for the handheld abrading machine to comprise two or more gear units, in particular, reduction gears for coupling the drive motor to the tool holder.

Preferably, both an end of the transmission shaft towards the drive motor and an end of the transmission shaft towards the tool holder are each provided with at least one gear unit.

It can be expedient if a suction channel of a suction device of the handheld abrading machine and the transmission shaft run together at least in sections thereof in a tubing element of the handheld abrading machine and in particular, in the tubular bar of the holding device.

As an alternative or in addition thereto, provision may be made for the handheld abrading machine to comprise at least two tubing elements, wherein one of the tubing elements is the tubular bar in which the transmission shaft runs at least in sections thereof, and wherein a further tubing element forms a suction channel section of the suction channel of the suction device. The tubing elements are preferably arranged such that they are substantially parallel to each other.

At least one tubing element is preferably rigid, bending resistant, inflexible and/or stiff.

Preferably, the tubular bar is rigid, bending resistant, inflexible and/or stiff.

A tubing element can be one-piece. Furthermore, provision may be made for a tubing element to consist of two parts and in particular, to be telescopic.

The substantially ring-shaped or ring-section-shaped suction channel section of the suction channel of the suction device is preferably connected in space-fixed manner to the coupling device and in particular to a gear unit by means of which the tool holder and an end of the transmission shaft towards the tool holder are coupled to one another.

In particular, provision may be made for the substantially ring-shaped or ring-section-shaped suction channel section and the coupling device to be arranged together in a common housing.

The housing may be formed by one or more injection molded components for example.

It can be advantageous, if the substantially ring-shaped or ring-section-shaped suction channel section and the coupling device for coupling the transmission shaft to the tool holder are fixed in a common housing.

Thereby, the substantially ring-shaped or ring-section-shaped suction channel section can be formed by a separate device for example.

As an alternative thereto, provision may be made for the substantially ring-shaped or ring-section-shaped suction channel section to be formed at least in sections thereof by the housing of the coupling device.

Preferably, a housing for accommodating the coupling device for coupling the transmission shaft to the tool holder forms the substantially ring-shaped or ring-section-shaped suction channel section.

The housing and the holding device are preferably connected to one another in pivotal manner by means of at least one swivel element. In particular, provision may be made for the housing to be connected to the holding device such as to be pivotal about one or more pivotal axes by means of at least one swivel element.

The substantially ring-shaped or ring-section-shaped suction channel section is arranged on the tool head. In particular, the substantially ring-shaped or ring-section-shaped suction channel section is a component of the tool head.

The substantially ring-shaped or ring-section-shaped suction channel section of the suction channel and a suction channel section of the suction channel running within a tubular bar of the holding device or within a separate tubing element are preferably connected to one another in fluid-conveying manner by means of a flexible suction channel section of the suction channel.

The substantially ring-shaped or ring-section-shaped suction channel section preferably adjoins a transition section on which the flexible suction channel section and in particular a substantially tubular flexible suction channel section is preferably arranged.

The flexible suction channel section is preferably formed by a flexible tubing element.

The transmission shaft preferably runs at least in sections thereof within a flexible tubing element which comprises and/or forms the flexible suction channel section.

In one embodiment of the invention, provision is made for the tool holder to be selectively couplable to the transmission shaft or removable and in particular detachable from the transmission shaft by means of the coupling device.

A rotational axis (axis of rotation) of the tool holder and/or an end of the transmission shaft towards the tool holder is preferably substantially perpendicular to one or more pivotal axes of the tool head.

It can be expedient if a rotational axis (axis of rotation) of an end of the transmission shaft towards the tool holder and one or more pivotal axes of the tool head intersect especially in each position of the tool head.

A tool accommodated in the tool holder is preferably drivable in rotary, oscillatory and/or eccentric manner.

For the purposes of attaching the tool to the tool holder, provision is preferably made for a releasable connection, in particular, by means of a hook and loop fastener.

The tool such as an abrading element for example is preferably fixable to the tool holder in releasable manner.

It can be expedient if the tool head comprises a hood device for covering the tool holder.

The hood device preferably comprises a hood element.

It can be expedient if the hood element has a hood chamber and in particular a substantially cylindrical hood chamber.

The tool holder and/or a tool arranged in the tool holder are preferably arrangeable in the hood chamber at least in sections thereof.

In particular, provision may be made for the tool holder together with a tool arranged thereon to be arrangeable in the hood chamber at least in sections thereof.

In one embodiment of the invention, provision is made for the hood element to comprise a recess and in particular, a recess in the form of a segment of a cylinder.

A tangent touching an edge of the tool arranged in the tool holder preferably runs substantially in a plane delimiting the recess and in particular, the recess in the form of a segment of a cylinder.

The recess-delimiting plane preferably runs substantially parallel to a rotational axis of the tool holder and the tool arranged thereon.

Preferably, edge regions and in particular edge regions of walls, floors or ceilings which would not be accessible when using hood elements that completely surround the tool holder can also be treated by means of the handheld abrading machine due to a recess in the hood element.

Thus in particular, a simple and efficient as well as maximally fatigue-free abrading process is possible due to such a hood element particularly one having a recess in the form of a segment of a cylinder.

The tool holder, the transmission shaft and the hood element are preferably arranged on a central element of the tool head in rotatable manner.

In particular, provision may be made for the tool holder, an end of the transmission shaft towards the tool holder and the hood element to be arranged on a central element of the tool head such as to be rotatable about at least approximately mutually parallel rotational axes and in particular about a common rotational axis.

It can be expedient if an axis of symmetry of the substantially cylindrical hood chamber (cylinder axis) is at least approximately identical to the rotational axis of the tool holder.

A central element of the tool head is preferably connected to the holding device such as to be pivotal about one or more pivotal axes.

A central element of the tool head is preferably a housing for a coupling device for coupling the transmission shaft to the tool holder.

The central element and in particular the housing preferably serves for accommodating a substantially tubular suction channel section of a suction channel of a suction device.

Provision may be made for a substantially ring-shaped or ring-section-shaped suction channel section of a suction channel of a suction device to be formed by the central element and in particular by the housing.

The hood device preferably comprises a braking device by means of which an unwanted rotational movement of the hood element is brakable. The braking device may comprise a spring device for example.

It can be expedient if the hood device comprises a cover element by means of which the recess and in particular the recess in the form of a segment of a cylinder is coverable in the hood element.

The suction of abraded material resulting from the abrading action of the abrading machine can preferably be simplified by the use of a cover element. In particular, abraded material developing during the abrading action of the abrading machine can preferably be prevented from escaping from the hood chamber through the recess by the use of a cover element.

The cover element is preferably moveable into a covering position in which the recess and in particular the recess in the form of a segment of a cylinder is covered, and into an open position in which the hood chamber is accessible through the recess. In this way, the hood device can be set selectively into an operating mode for abrading large surface areas (cover element in the covering position) or into an operating mode for abrading close to edges (cover element in the open position).

The cover element can, for example, be arranged on the hood element in rotatable, pivotal, hinged and/or releasable manner. In this way, the cover element can be transferred from the covering position into the open position and/or from the open position into the covering position in a particularly simple manner.

In particular, provision may be made for the cover element to be rotatable or pivotal about a (pivotal) axis that is oriented at least approximately perpendicularly to the rotational axis of the tool holder.

As an alternative thereto, provision may be made for the cover element to be rotatable or pivotal about a (rotational) axis that is oriented at least approximately parallel to the rotational axis of the tool holder.

In particular, provision may be made for the cover element, the tool holder, an end of the transmission shaft towards the tool holder and/or the hood element to be rotatable about a common rotational axis.

The cover element, the tool holder, an end of the transmission shaft towards the tool holder and/or the hood element are preferably arranged on a central element of the tool head.

It can be advantageous if the hood element comprises a sealing device, in particular, a brush device.

The sealing device preferably serves to allow the hood element to be placed gently on a surface that is to be treated by means of the abrading machine. In particular thereby, the hood chamber can be sealed with respect to the environment in order to enable the abraded material resulting from the abrading action of the abrading machine to be deliberately sucked away.

The sealing device is preferably formed and/or arranged to be resilient or spring-mounted. Thereby, the hood element can preferably be placed on a surface that is to be treated in gently and reliably sealing manner.

The sealing device and in particular the brush device preferably extends along the periphery of the cylindrical hood chamber.

In particular, provision may be made for the sealing device to extend along the periphery of the cylindrical hood chamber at least approximately from one side of the recess and in particular the recess in the form of a segment of a cylinder up to the side of the recess and in particular the recess in the form of a segment of a cylinder which is located opposite said one side.

It can be expedient if the cover element comprises a sealing device such as a brush device for example.

The sealing device and in particular the brush device of the hood element can preferably be expanded into a sealing device and in particular a brush device which substantially completely surrounds the hood chamber in ring-like manner by means of the sealing device and in particular the brush device of the cover element.

Preferably, the sealing device is arranged on the cover element in such a way that, in a covering position of the cover element, the sealing device of the hood element and the sealing device of the cover element form a sealing ring, particularly a brush collar, which at least approximately completely surrounds the hood chamber and in particular the cylindrical hood chamber in annular manner.

The hood device preferably comprises one or more contact sections, the surfaces of which form a contact surface for the lateral placement of the tool head.

The contact surface preferably runs at least approximately in the plane which delimits the recess and in particular, the recess in the form of a segment of a cylinder.

In particular, the tool head can be placed laterally on a wall, a floor and/or a ceiling by means of the contact surfaces. In particular thereby, the edge regions of mutually adjoining walls, floors and/or ceilings can be treated in a simple and efficient manner.

The hood element may, for example, be formed in one-piece manner with at least one contact section of the hood device.

Furthermore, provision may be made for the hood device to comprise one or more separate contact elements which form one or more contact sections of the hood device.

In a further embodiment of the invention, provision is made for a motor shaft rotational axis of the drive motor to be oriented transversely and in particular inclined relative to a longitudinal axis of the tubular bar.

Due to such an orientation of the motor shaft rotational axis relative to the longitudinal axis of the tubular bar, a center of gravity of the handheld abrading machine can preferably be purposefully adjusted, especially optimized. Thereby, a simple, efficient and as fatigue-free an abrading action as possible can be obtained.

The longitudinal axis of the tubular bar is preferably a longitudinal axis, an axis of symmetry and/or a mid axis of a central section of the tubular bar between the drive motor and the tool head.

In particular thereby, a central section is a middle section of the tubular bar in which a center of the tubular bar (taken with respect to its longitudinal extent) is arranged.

Provision may be made for the longitudinal axis of the tubular bar to be a longitudinal axis, an axis of symmetry and/or a mid axis of a central linear section of the tubular bar between the drive motor and the tool head.

Furthermore, the longitudinal axis of the tubular bar can preferably be a longitudinal axis of an engagement region of the tubular bar which is gripped by a user when the abrading machine is effecting an abrading action.

It can be expedient if a center of gravity of the drive motor and a center of gravity of the tool head are arranged on mutually opposite sides of the longitudinal axis of the tubular bar.

Preferably, a distinction can be made between a motor side on which the drive motor is located and a tool side on which the tool is arranged, taken with respect to the longitudinal axis of the tubular bar.

In particular, provision may be made for the center of gravity of the handheld abrading machine to be arranged in the proximity of the central section, in particular the middle section, of the tubular bar or within the tubular bar, in particular within the central section, such as the e.g. middle section, of the tubular bar.

The tubular bar preferably comprises one or more guide elements for the guidance of the transmission shaft and in particular for the guidance of the transmission shaft within the tubular bar.

A guide element can be in the form of a guide channel or a guide ring for example.

In one embodiment of the invention, provision is made for the transmission shaft to be flexible at least in sections thereof.

Preferably, the transmission shaft is bent or curved at least in sections thereof within the tubular bar particularly in a substantially linear section of the tubular bar.

It can be expedient if the transmission shaft is fed into the tubular bar at the proximal end of the tubular bar in a direction running transversely and in particular inclined relative to the longitudinal axis of the tubular bar.

Furthermore, provision may be made for the transmission shaft to be fed into the tubular bar at the proximal end of the tubular bar substantially parallel to an axis of symmetry of the proximal end of the tubular bar.

The proximal end of the tubular bar and/or the distal end of the tubular bar preferably comprises at least one bend.

It can also be expedient however, if the tubular bar is entirely linear, i.e. if the tubular bar has a linear axis of symmetry.

It can be expedient if the transmission shaft is fed out of the tubular bar at the distal end of the tubular bar in a direction running transversely and in particular inclined relative to the longitudinal axis of the tubular bar.

Furthermore, provision may be made for the transmission shaft to be fed out of the tubular bar at the distal end of the tubular bar substantially parallel to an axis of symmetry of the distal end of the tubular bar.

In one embodiment of the invention, provision is made for the motor shaft rotational axis and a rotational axis of the end of the transmission shaft towards the drive motor to be mutually offset.

The drive motor and the transmission shaft are preferably connected to one another by means of an offsetting device with the aid of which a rotational movement of a motor shaft of the drive motor is transferable to an end of the transmission shaft towards the drive motor that is offset relative to the motor shaft.

The offsetting device can, for example, be a gear unit and in particular a reduction gear.

It can be expedient if an opening is provided at an end of the tubular bar which preferably forms a base area of the tubular bar through which the transmission shaft is fed into an interior space of the tubular bar or is fed out of the interior space of the tubular bar.

As an alternative or in addition thereto, provision may be made for the tubular bar to comprise one or more through-openings which differ from openings at the ends of the tubular bar and in particular openings which form a base area of the tubular bar.

Preferably, the transmission shaft is fed into an interior space of the tubular bar through such a through-opening.

As an alternative or in addition thereto, provision may be made for the transmission shaft to be fed out of the interior space of the tubular bar through such a through-opening.

It can be expedient if an opening is provided at an end of the tubular bar which preferably forms a base area of the tubular bar, whereby an interior space of the tubular bar serving as a suction channel section of a suction channel of a suction device is connected via the opening to the tool head in fluid-conveying manner by means of at least one further suction channel section.

In particular, provision may be made for both openings at the ends of the tubular bar which form the base area of the tubular bar to connect an interior space of the tubular bar serving as a suction channel section of the suction channel of the suction device to further suction channel sections of the suction channel of the suction device in fluid-conveying manner.

As an alternative or in addition thereto, provision may be made for the tubular bar to comprise a through-opening which differs from openings at the ends of the tubular bar and by means of which an interior space of the tubular bar serving as a suction channel section of a suction channel of a suction device is connected to at least one further suction channel section of the suction channel of the suction device in fluid-conveying manner.

In one embodiment of the invention, provision is made for the tubular bar to comprise an engagement region which is gripped by a user when the abrading machine is effecting an abrading action.

A center of gravity of the drive motor and a center of gravity of the tool head are preferably arranged on mutually opposite sides of a longitudinal axis of the tubular bar and in particular, respectively on a motor side and on a tool side.

The handheld abrading machine thereby preferably has a balanced weight distribution so that a simple, efficient and as fatigue-free an abrading action as possible is obtained.

It can be advantageous if a motor shaft rotational axis of the drive motor is oriented substantially parallel to the longitudinal axis of the tubular bar.

As an alternative thereto, provision may be made for a motor shaft rotational axis of the drive motor to be oriented transversely and in particular inclined relative to a longitudinal axis of the tubular bar.

The motor shaft rotational axis is preferably offset relative to the longitudinal axis of the tubular bar.

In particular, an offset arrangement is to be understood as a spaced, skewed or parallel arrangement.

The transmission shaft for the transmission of torque from the drive motor to the tool holder is preferably flexible at least in sections thereof.

The longitudinal axis of the tubular bar is preferably a longitudinal axis of an engagement region of the tubular bar which is gripped by a user when the abrading machine is effecting an abrading action.

In particular thereby, the longitudinal axis of the tubular bar is an axis of symmetry of the engagement region of the tubular bar.

The engagement region of the tubular bar is preferably arranged between the drive motor and the tool head.

A motor shaft of the drive motor and an end of the transmission shaft towards the drive motor are preferably mutually offset with respect to a direction running perpendicularly to the longitudinal axis of the tubular bar and/or with respect to a direction running parallel to the longitudinal axis of the tubular bar.

In one embodiment of the invention, provision is made for a motor shaft rotational axis, a rotational axis of an end of the transmission shaft towards the drive motor and/or a rotational axis of a section of the transmission shaft running in the engagement region of the tubular bar to run at least approximately parallel to each other.

Furthermore, provision may be made for a motor shaft rotational axis, a rotational axis of an end of the transmission shaft towards the drive motor and/or a rotational axis of a section of the transmission shaft running in the engagement region of the tubular bar to run transversely and in particular inclined relative to each other.

In one embodiment of the invention, provision is made for a motor shaft rotational axis, a rotational axis of an end of the transmission shaft towards the drive motor and/or a rotational axis of a section of the transmission shaft running in the engagement region of the tubular bar to be mutually offset with respect to a direction running perpendicularly to the longitudinal axis of the tubular bar.

It can be expedient if the drive motor and the transmission shaft are connected to one another by means of an offsetting device.

Preferably, a rotational movement of a motor shaft of the drive motor is transferable to an end of the transmission shaft towards the drive motor that is offset relative to the motor shaft by means of the offsetting device.

In particular, the offsetting device comprises a gear unit such as a reduction gear for example.

In particular, provision may be made for the offsetting device to comprise a gear wheel device for the transmission of the rotational movement.

Furthermore, provision may be made for the offsetting device to comprise a toothed belt device for the transmission of the rotational movement.

It can be expedient if a motor shaft of the drive motor and an end of the transmission shaft towards the drive motor are at least approximately mutually coaxial.

The motor shaft of the drive motor and an end of the transmission shaft towards the drive motor preferably have a common rotational axis.

A motor shaft of the drive motor and a section of the transmission shaft running in the engagement region of the tubular bar are preferably mutually offset with respect to a direction running perpendicularly to the longitudinal axis of the tubular bar.

The motor shaft of the drive motor and a section of the transmission shaft running in the engagement region of the tubular bar are preferably connected to one another by means of a flexible section of the transmission shaft.

In particular, the flexible section forms an offsetting device for the transmission of the rotational movement of the motor shaft of the drive motor to the section of the transmission shaft running in the engagement region of the tubular bar.

In one embodiment of the invention, provision may be made for the spacing between the drive motor and the tool head to be adjustable and in particular continuously adjustable.

To this end, the abrading machine may comprise a telescopic device.

The tubular bar connecting the drive motor to the tool head and/or further e.g. tubular elements for connecting the drive motor to the tool head are preferably telescopic.

For example, provision may be made for the tubular bar and/or the further tubular elements and in particular tubing elements as well as the transmission shaft to be formed of at least two parts, whereby in particular, the two parts are displaceable on one another with respect to the longitudinal direction.

The two parts of the transmission shaft are preferably connected to one another with positive engagement with respect to at least one direction running perpendicularly to the longitudinal axis of the tubular bar so that a rotational movement can be transferred by means of the transmission shaft.

The abrading machine and in particular the holding device of the abrading machine, can preferably comprise a handle element. The abrading machine is thereby particularly easy and comfortable to handle.

An interior space of the tubular bar can, for example, be formed in two-parts and in particular split along the longitudinal axis.

An interior space part of the interior space of the tubular bar preferably forms a suction channel section of a suction channel of a suction device.

A further interior space part of the interior space of the tubular bar preferably serves for accommodating and/or guiding the transmission shaft.

The tool holder of the tool head is preferably removable from the tool head and in particular from the coupling device, and is exchangeable for a tool holder of the same type or of another type, for example, ones having a different shape, different diameter and/or a different type of movement (e.g. rotatory or oscillatory).

A hood device for covering the tool holder preferably comprises a hood element which is formed in one piece manner and surrounds the substantially cylindrical hood chamber.

A braking device for preventing an unwanted rotation of the hood device relative to a central element on which the hood element is preferably rotatable may, for example, comprise a clamping device and/or a device for connecting the relatively rotatable components in frictional manner.

With respect to a position of the handheld abrading machine in which the tool head together with the tool holder or a tool accommodated in the tool holder rests upon a floor, the drive motor is preferably arranged above the tubular bar.

However, provision could also be made for the drive motor to be arranged underneath the tubular bar and in particular, underneath the tubular bar in the vicinity of or after one or more bends of the tubular bar.

Furthermore, provision may be made for the drive motor to directly follow an end of the tubular bar. In particular hereby, provision may be made for the motor shaft rotational axis to be at least approximately identical to an axis of symmetry of an end of the tubular bar towards the drive motor.

A center of gravity of the handheld abrading machine is preferably arranged within the tubular bar and in particular as closely as possible to the longitudinal axis, the mid axis and/or the axis of symmetry of the tubular bar. The occurrence of moments affecting the rotational movement even during rotation of the handheld abrading machine about the longitudinal axis of the tubular bar can be reduced thereby or completely prevented.

Preferably, the abrading machine has two gear units and in particular two reduction gears which are arranged at the proximal end and/or at the distal end of the tubular bar and/or on the tool head.

The center of gravity of the drive motor preferably lies at least approximately 30 mm and in particular at least approximately 50 mm, approximately 55 mm for example, above, i.e. remote from the tool head, the longitudinal axis of the tubular bar.

The motor shaft rotational axis preferably includes an angle of at least approximately 5° and in particular at least approximately 10°, approximately 12° for example with the longitudinal axis of the tubular bar. Furthermore, the motor shaft rotational axis includes an angle of at most approximately 45° and in particular of at most approximately 30° with the longitudinal axis of the tubular bar.

All of the previously described features as well as the features described hereinafter in connection with the exemplary embodiments can make a contribution to a simple, efficient and as fatigue-free an abrading process as possible by means of the handheld abrading machine and are therefore combinable with one another as desired for producing advantageous embodiments of the invention.

Further preferred features and/or advantages of the invention form the subject matter of the following description and the graphical illustration of exemplary embodiments.

BRIEF DESCRIPTION OF THE DRAWINGS

Similar or functionally equivalent elements are provided with the same reference symbols in all the Figures.

DETAILED DESCRIPTION OF THE DRAWINGS

Figure 1:
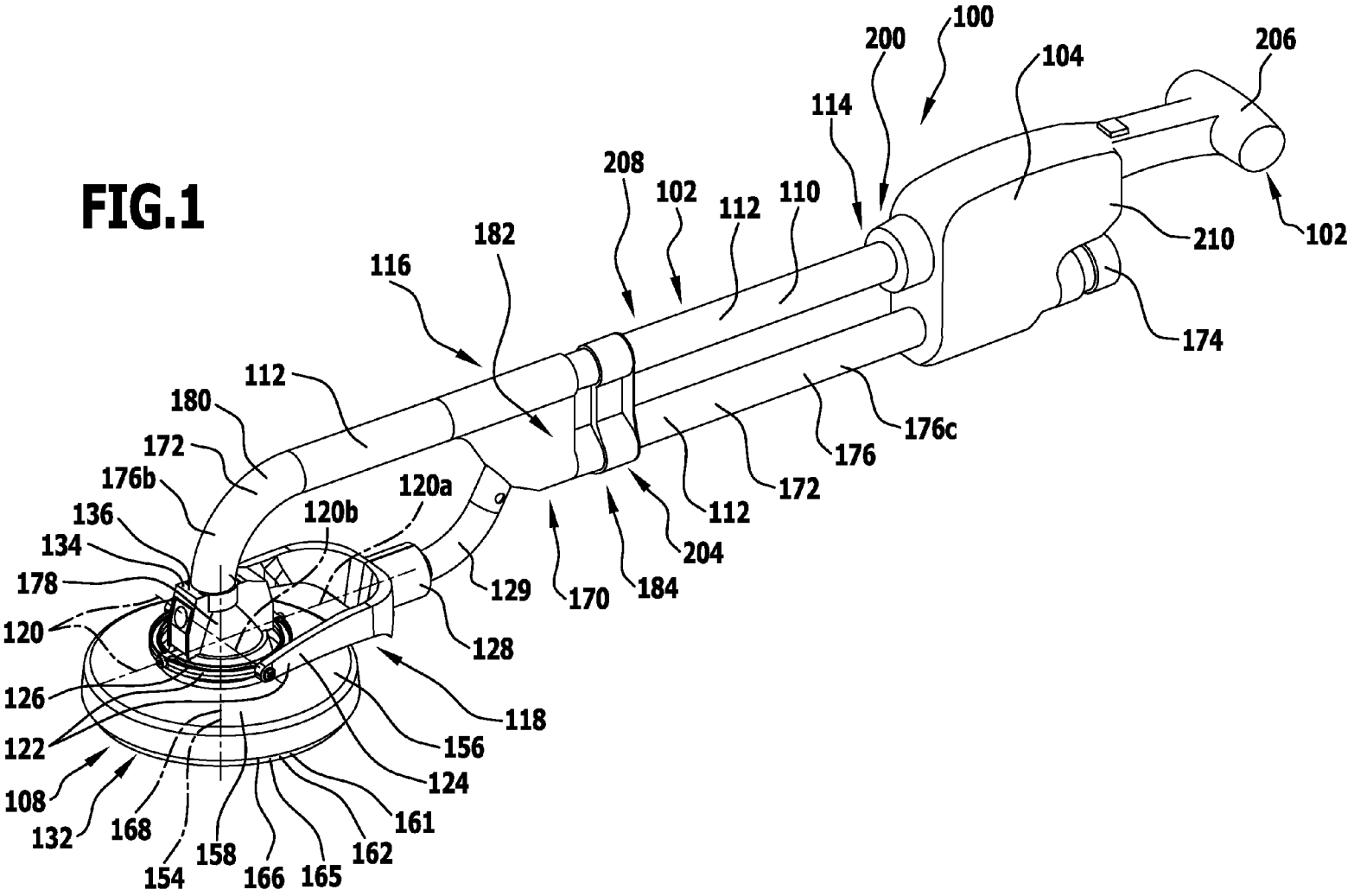
FIG. 1 shows a schematic perspective illustration of a first embodiment of a handheld abrading machine.

A first embodiment of a handheld abrading machine bearing the general reference 100 which is illustrated in FIGS. 1 to 9 comprises a holding device 102 for holding the abrading machine 100, a drive motor 104 for driving a tool 106 and a tool head 108 for holding the tool 106.

The drive motor 104 and the tool head 108 are connected to one another by means of a tubular bar 110.

The tubular bar 110 comprises at least one tubing element 112.

The tubular bar 110 is rigid and inflexible.

The drive motor 104 is arranged at a proximal end 114 of the tubular bar 110.

The tool head 108 is arranged at a distal end 116 of the tubular bar 110.

The drive motor 104 is preferably arranged directly at the proximal end 114 of the tubular bar 110, being fixed to the tubular bar 110 by means of a housing 210 of the drive motor 104 for example.

A swivel device 118 is provided for the purposes of arranging the tool head 108 at the distal end 116 of the tubular bar 110.

The tool head 108 is pivotal relative to the tubular bar 110 by means of the swivel device 118.

In particular, the tool head 108 is pivotal relative to the holding device 102 of the handheld abrading machine 100 about one or more, in particular two, pivotal axes 120.

To this end, the swivel device 118 comprises at least one swivel element 122.

In particular, the swivel device 118 comprises a swivel element 122 in the form of a swivel fork 124.

Furthermore, the swivel device 118 comprises a swivel element 122 in the form of a swivel ring 126.

The swivel fork 124 is preferably arranged on an attachment arm 129 of the holding device 102 by means of an attachment element 128 in rotatable or, alternatively, in mutually non-rotatable manner.

In particular, the attachment arm 129 is connected to the tubular bar 110.

The swivel fork 124 and thus too the tool head 108 that is held by means of the swivel fork 124 are pivotal relative to the attachment min 129 about a first pivotal axis 120*a*.

Furthermore, the tool head 108 is pivotal about a second pivotal axis 120*b* which is oriented perpendicularly to the first pivotal axis 120*a* by means of the swivel fork 124 and the swivel ring 126.

The first pivotal axis 120*a* and the second pivotal axis 120*b* preferably intersect, but could also be mutually offset for example.

The handheld abrading machine 100 comprises a transmission shaft 130 by means of which a rotational movement of the drive motor 104 is transferable to a tool holder 132 for holding the tool 106.

In particular, torque is transferable from the drive motor 104 to the tool holder 132 and the tool 106 arranged thereon by means of the transmission shaft 130.

The transmission shaft 130 runs at least in sections thereof within the tubular bar 110.

Preferably, the transmission shaft 130 is guided within the tubular bar 110. To this end, provision may be made for (yet to be described) guide elements 270.

Figure 2:
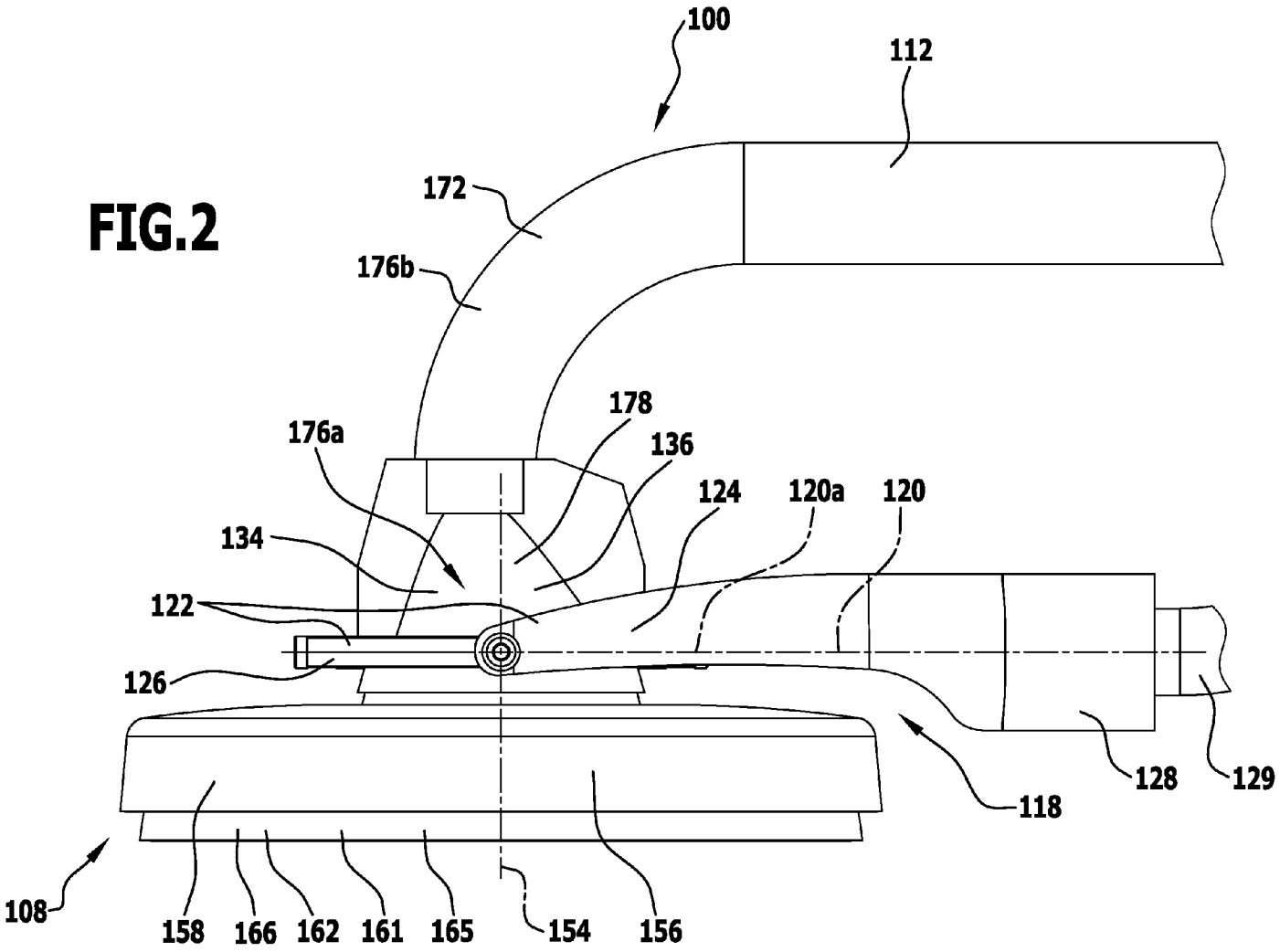
FIG. 2 a schematic side view of a tool head of the abrading machine depicted in FIG. 1.
Figure 3:
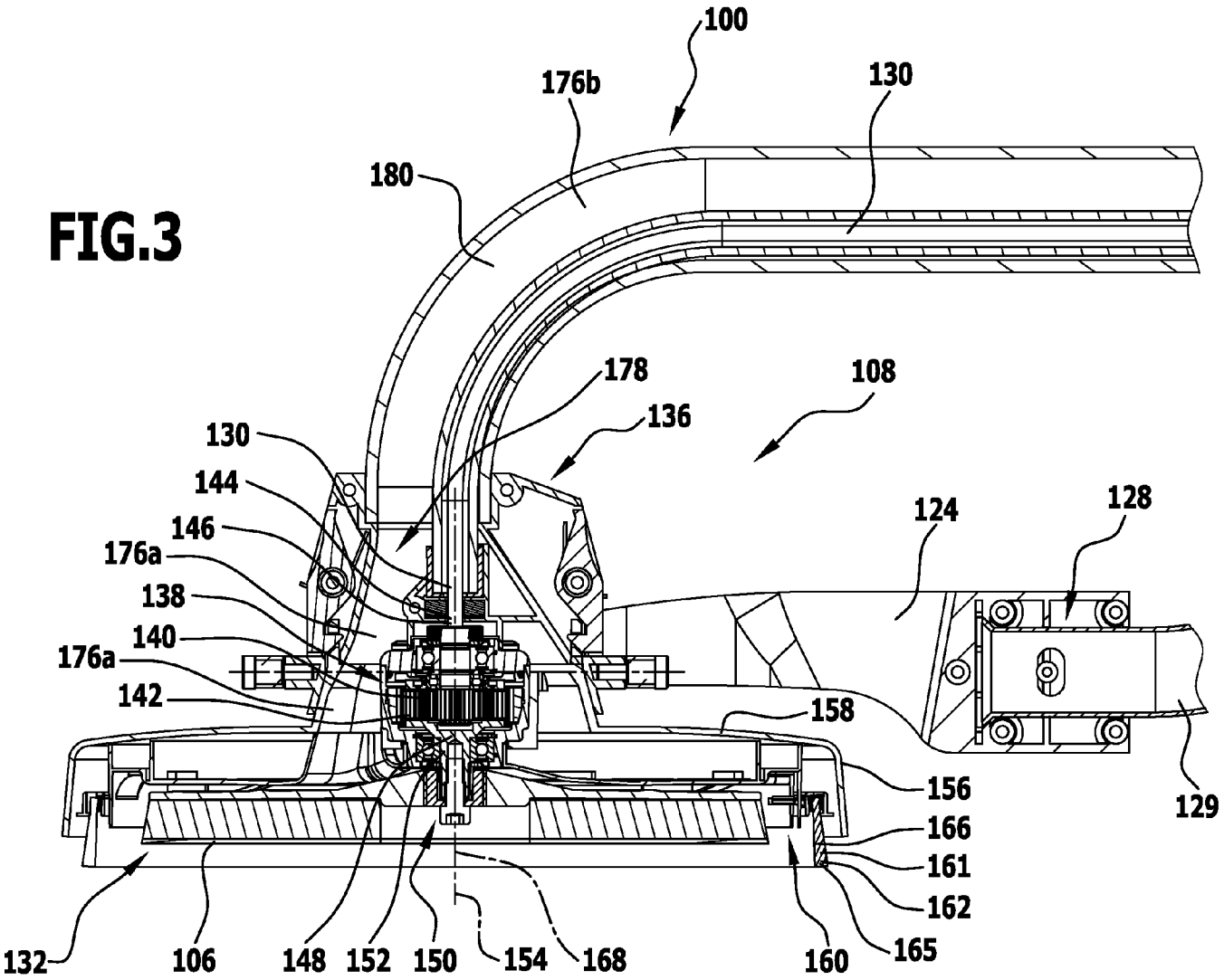
FIG. 3 a vertical longitudinal section through the tool head of the abrading machine depicted in FIG. 1.
Figure 4:
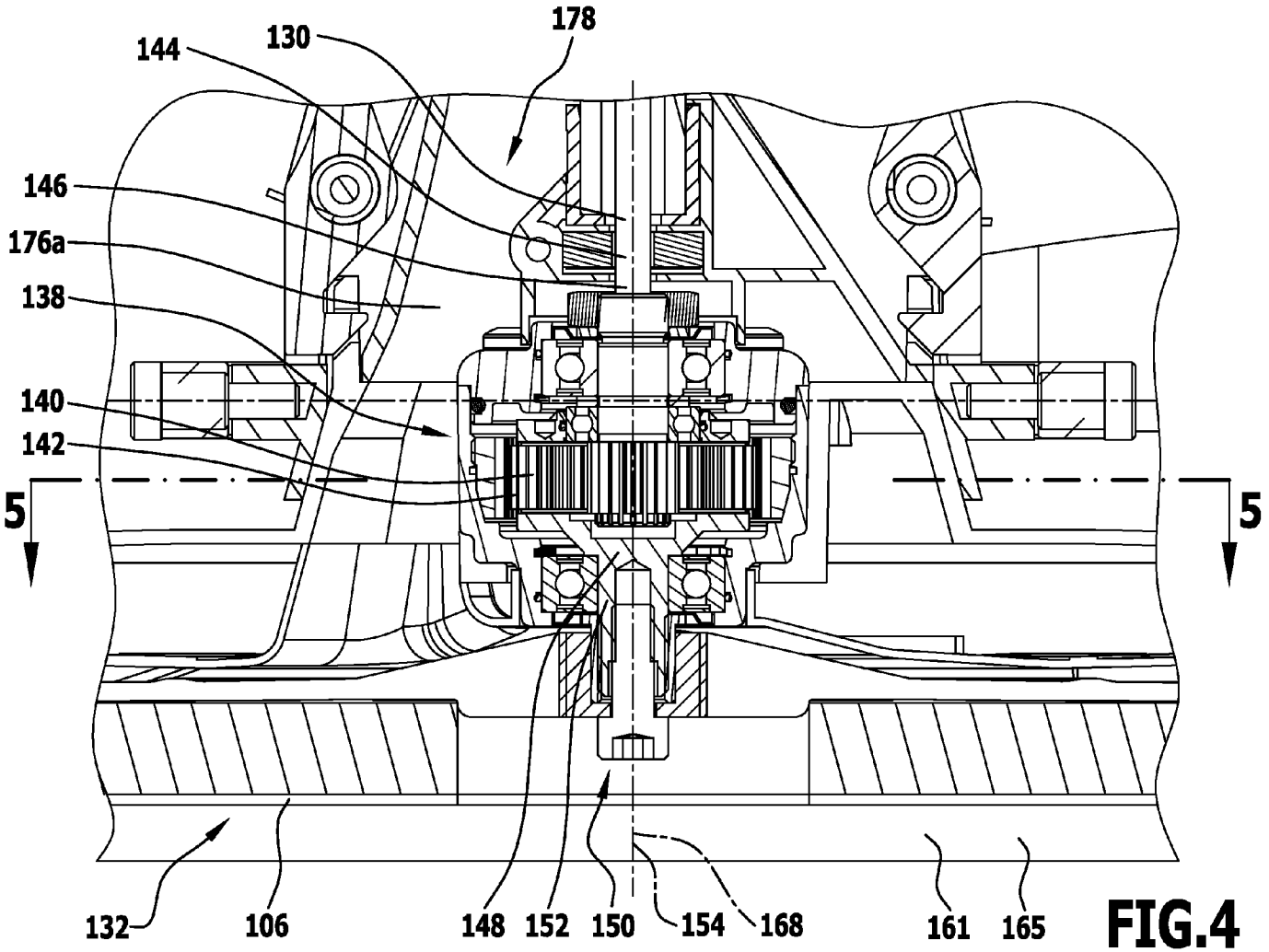
FIG. 4 an enlarged illustration of a coupling device of the tool head depicted in FIG. 3.

As can be derived in particular from FIGS. 2 and 3, the tool head 108 comprises a central element 134 which is gripped by the swivel device 118.

In particular, the central element 134 is a housing 136 for a coupling device 138 that is used for coupling the transmission shaft 130 to the tool holder 132.

The coupling device 138 comprises a gear unit 140 and in particular, a planetary gear 142.

An end 144 of the transmission shaft 130 towards the tool holder 132 forms a drive shaft 146 of the coupling device 138 or is connected in line therewith to a drive shaft 146 of the coupling device 138.

A tool holder shaft 148, such as a releasable connecting device 150 for connecting the tool holder 132 to the coupling device 138 in releasable manner, forms an output shaft 152 of the coupling device 138 or is connected to such an output shaft 152 aligned therewith.

Due in particular to the construction of the gear unit 140 in the form of a planetary gear 142, the drive shaft 146 and the output shaft 152 have an at least approximately common rotational axis 154.

Thus too, the end 144 of the transmission shaft 130 towards the tool holder 132 and the tool holder 132 have a common rotational axis 154.

Smooth and low-vibratory operation of the abrading machine 100 can be achieved due to this common rotational axis 154.

Figure 5:
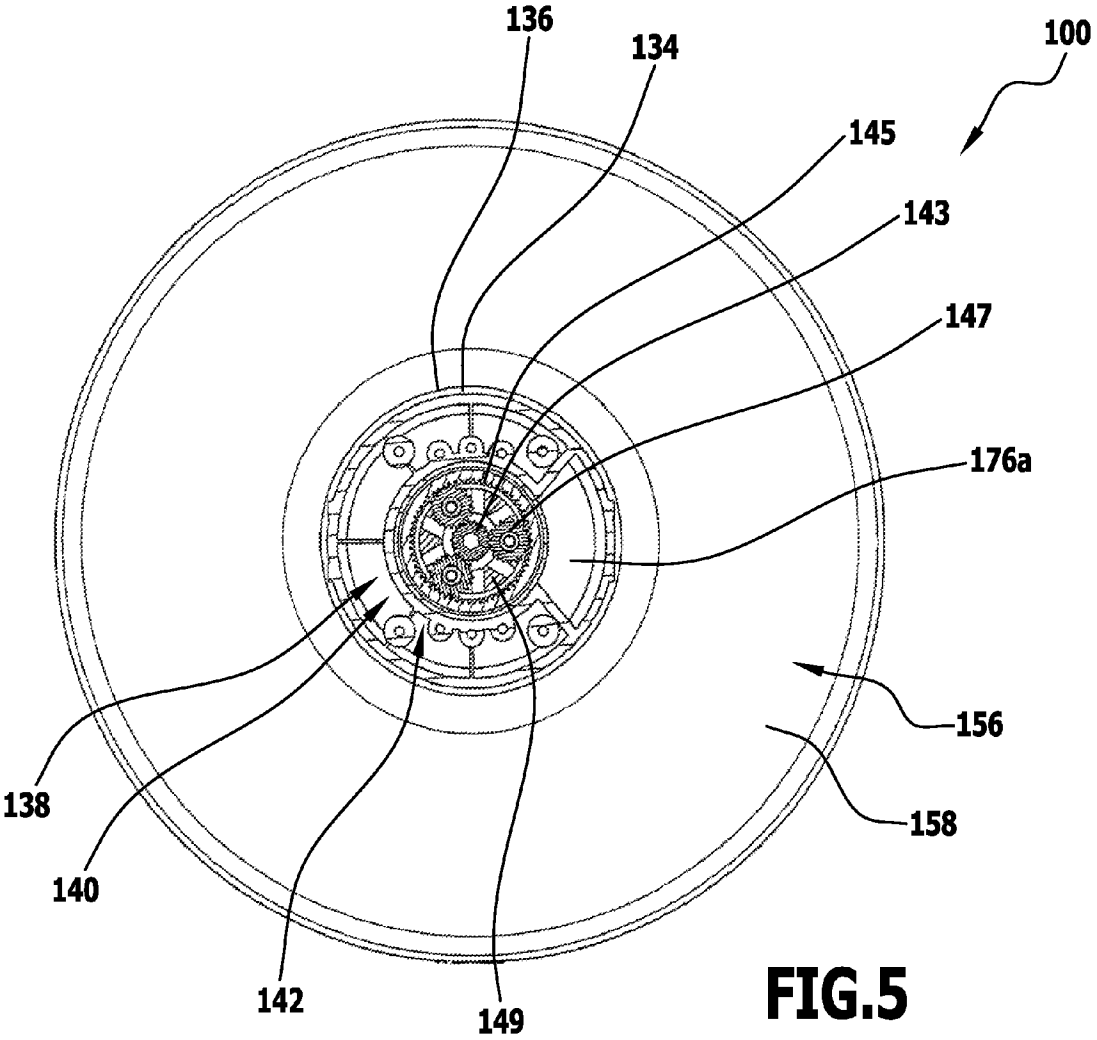
FIG. 5 a schematic horizontal section through the tool head along the line 5-5 in FIG. 4.

As can be derived in particular from FIG. 5, the planetary gear 142 comprises a central wheel 143 which is also referred to as a sun wheel, an outer wheel 145 which is also referred to as a crown wheel, and a plurality such as three for example, of planet wheels 147. The planet wheels 147 are rotatable on a planet wheel carrier 149.

The drive shaft 146 engages with the central wheel 143 for example.

The output shaft 152 engages with the planet wheel carrier 149 for example.

The outer wheel 145 is connected to the housing 136 in mutually non-rotatable manner for example.

In alternative embodiments, provision may be made for the drive shaft 146 to engage with the planet wheel carrier 149 or the outer wheel 145. The output shaft 152 then engages with the central wheel 143 or the planet wheel carrier 149 for example, whilst the outer wheel 145 or the central wheel 143 is connected to the housing 136 in mutually non-rotatable manner.

As can be derived from FIG. 3 furthermore, the tool head 108 also comprises a hood device 156.

The hood device 156 covers the tool holder 132.

To this end in particular, the hood device 156 comprises a hood element 158 which surrounds a hood chamber 160.

The hood chamber 160 is substantially cylindrical whereby a diameter of the hood chamber 160 is a multiple of the height of the hood chamber 160.

Furthermore, the hood device 156 comprises a sealing device 161 and in particular a brush device 162 which extends along a peripheral direction 164 of the hood chamber 160 and forms a sealing ring 165 and in particular a ring-shaped brush collar 166.

The hood element 158, the hood chamber 160, the sealing device 161 and the tool holder 132 preferably have a common rotational axis 154.

In particular thereby, the rotational axis 154 is an axis of symmetry 168 of the hood element 158, the hood chamber 160, the sealing device 161 and the tool holder 132.

Due to the arrangement of the tool holder 132 and the tool 106 in the hood chamber 160, abraded material occurring when the abrading machine 100 is operating can be kept within the tool head 108. In particular, the sealing device 161 can be placed on a surface that is to be treated so that a substantially closed hood chamber 160 is formed by means of the hood element 158 and the surface. Contamination of the environment of the abrading machine 100 can thereby be prevented.

In order to enable the abraded material resulting from the abrading action of the abrading machine 100 to be removed from the tool head 108, there is provided, in particular, a suction device 170.

The suction device 170 comprises a suction channel 172 which connects the hood chamber 160 in fluid-conveying manner to a (not illustrated) suction device such as a vacuum cleaner for example that is connectable to a connector device 174 of the abrading machine 100.

The suction channel 172 comprises a plurality of suction channel sections 176.

In particular, the suction channel 172 has a substantially ring-shaped or ring-section-shaped suction channel 176*a*, a flexible suction channel section 176*b* and a tubular suction channel section 176*c*.

The substantially ring-shaped or ring-section-shaped suction channel section 176*a* (see in particular FIGS. 3 and 4) surrounds at least in sections thereof the coupling device 138 in substantially annular manner.

In particular, the ring-shaped or ring-section-shaped suction channel section 176*a* and the coupling device 138 have an at least approximately common axis of symmetry 168.

The abraded material collecting in the hood chamber 160 as a result of the abrading action of the abrading machine 100 can be removed in a particularly constant and reliable manner from the hood chamber 160 by means of the ring-shaped or ring-section-shaped suction channel section 176*a*.

The ring-shaped or ring-section-shaped suction channel section 176*a* is connected to the flexible suction channel section 176*b* in fluid-conveying manner by means of a transition section 178.

Both the ring-shaped or ring-section-shaped suction channel section 176*a* and the transition section 178 are formed by a suitable shaping of the housing 136 of the tool head 108.

A flexible tubing element 180 which comprises or forms the flexible suction channel section 176*b* is arranged on the transition section 178. The flexible tubing element 180 connects the housing 136 to the tubular bar 110.

Figure 6:
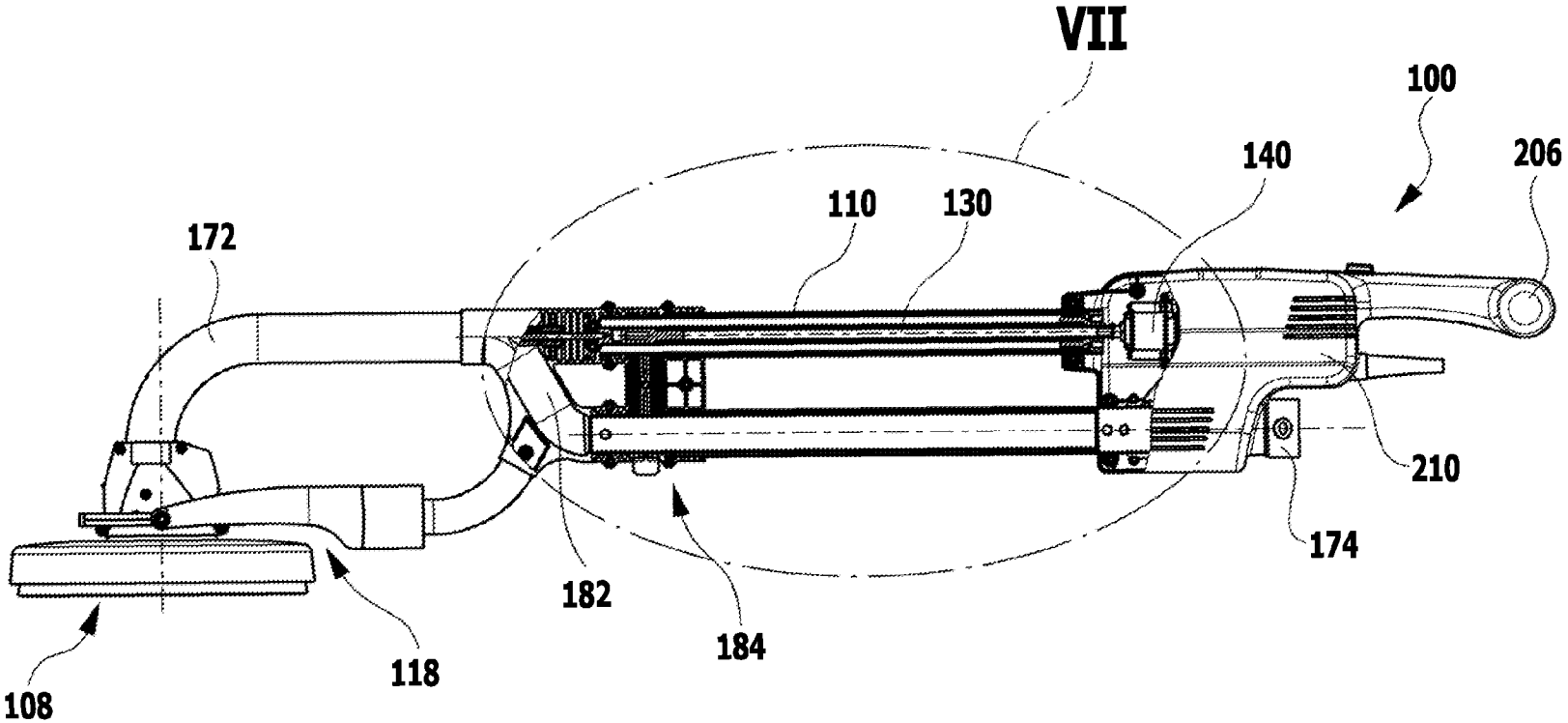
FIG. 6 a schematic, partly sectional side view of the abrading machine depicted in FIG. 1 in a completely pushed-in position of the abrading machine.
Figure 7:
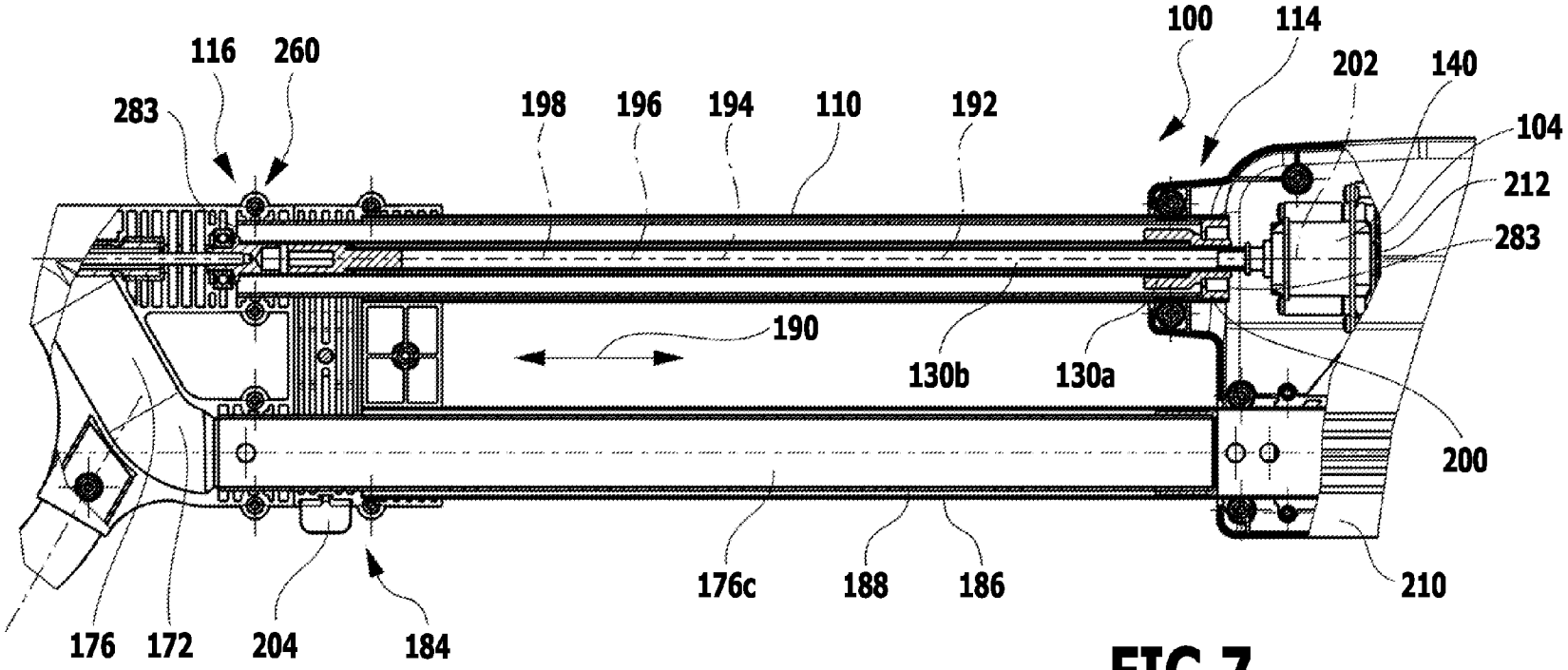
FIG. 7 an enlarged illustration of the region VII in FIG. 6.
Figure 8:
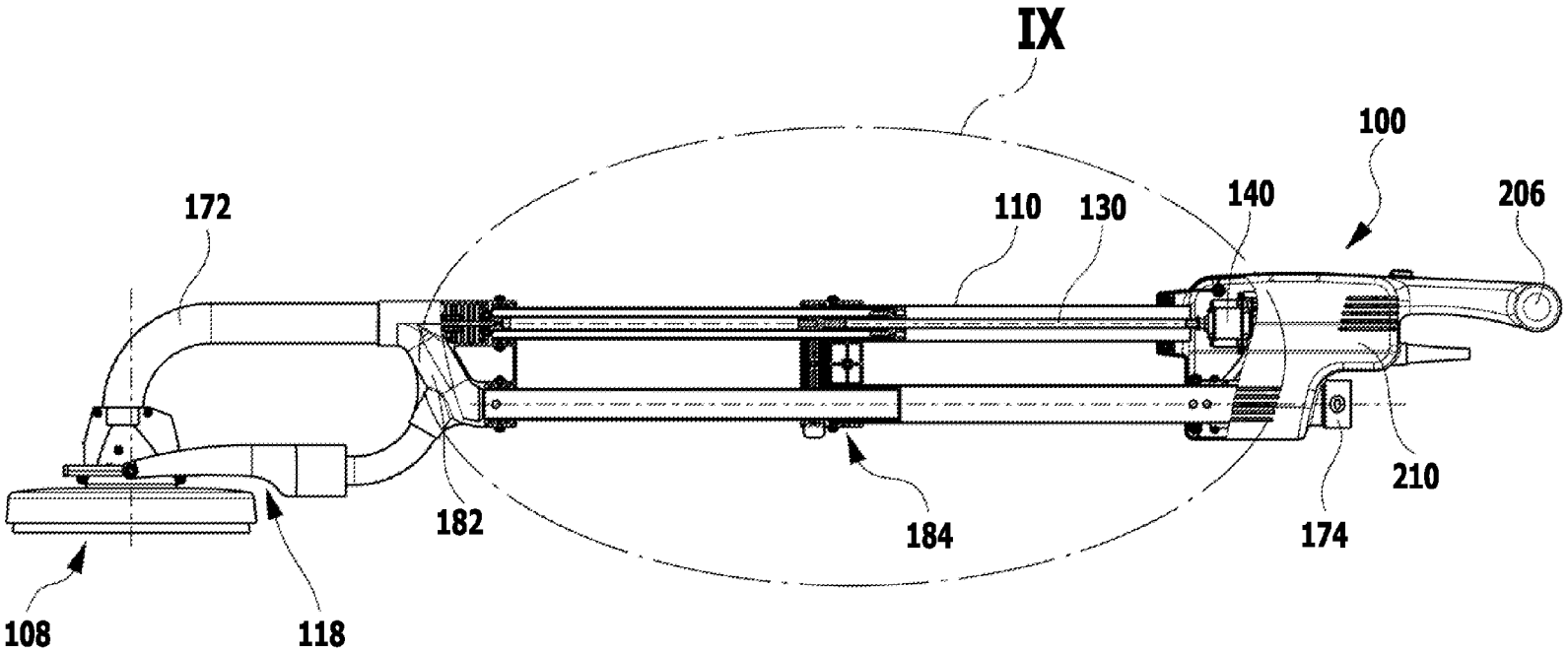
FIG. 8 a schematic side view corresponding to FIG. 6 of the abrading machine depicted in FIG. 1 in a completely drawn-out position thereof.

As can be derived in particular from FIGS. 6 and 7, provision is made in the first embodiment of the handheld abrading machine 100 that is illustrated in FIGS. 1 to 9 for the drive motor 104 and the tool head 108 to be connected to one another by means of two tubing elements 112 which run in parallel with each other.

A tubing element 112 forming the tubular bar 110, in which the transmission shaft 130 runs, joins the flexible suction channel section 176*b* and ends in the vicinity of the drive motor 104.

The further tubing element 112 which is arranged in parallel with and is offset relative to the tubular bar 110 is connected in fluid-conveying manner to the flexible tubing element 180 forming the flexible suction channel section 176*b* by means of a fork-piece 182.

Commencing from the fork-piece 182, the further tubing element 112 extends underneath and then past the drive motor 104 up to the connector device 174.

Thus, in the case of the first embodiment of the handheld abrading machine 100 that is illustrated in FIGS. 1 to 9, separate tubing elements 112 are provided for accommodating the transmission shaft 130 and for the tubular suction channel section 176*c*.

However, the transmission shaft 130 runs in sections thereof within the suction channel 172 particularly in the flexible tubing element 180.

As can be derived in particular from FIGS. 6 to 9, the handheld abrading machine 100 in the first embodiment that is illustrated in FIGS. 1 to 9 comprises a telescopic device 184 by means of which the spacing of the drive motor 104 from the tool head 108 is adjustable.

In particular, a working range attainable in operation of the abrading machine 100 can be established thereby.

The telescopic device 184 is formed in that the tubing elements 112 which form the tubular bar 110 and the tubular suction channel section 176*c* are in each case formed of two parts.

Thereby, the tubing elements 112 each comprise an outer part 186 and an inner part 188 whereby the outer part 186 and the inner part of 188 are displaceable relative to each other.

The length of the tubing elements 112 can thereby be varied.

Preferably, the transmission shaft 130 is also formed of at least two parts wherein a first part 130*a* and a second part 130*b* are likewise displaceable relative to each other.

The first part 130*a* and the second part 130*b* of the transmission shaft 130 are connected to one another with positive engagement in a direction oriented perpendicularly with respect to an extension direction 190 of the telescopic device 184 in order to enable torque to be transmitted.

The extension direction 190, a transmission shaft rotational axis 192 of the transmission shaft 130 within the tubular bar 110 and in particular in an engagement region 208 of the tubular bar 110, a longitudinal axis 194 of the tubular bar 110, a mid axis 196 of the tubular bar 110 and/or an axis of symmetry 198 of the tubular bar 110 are in parallel with each other.

In particular, the longitudinal axis 194, the mid axis 196 and the axis of symmetry 198 of the tubular bar 110 are identical.

Figure 9:
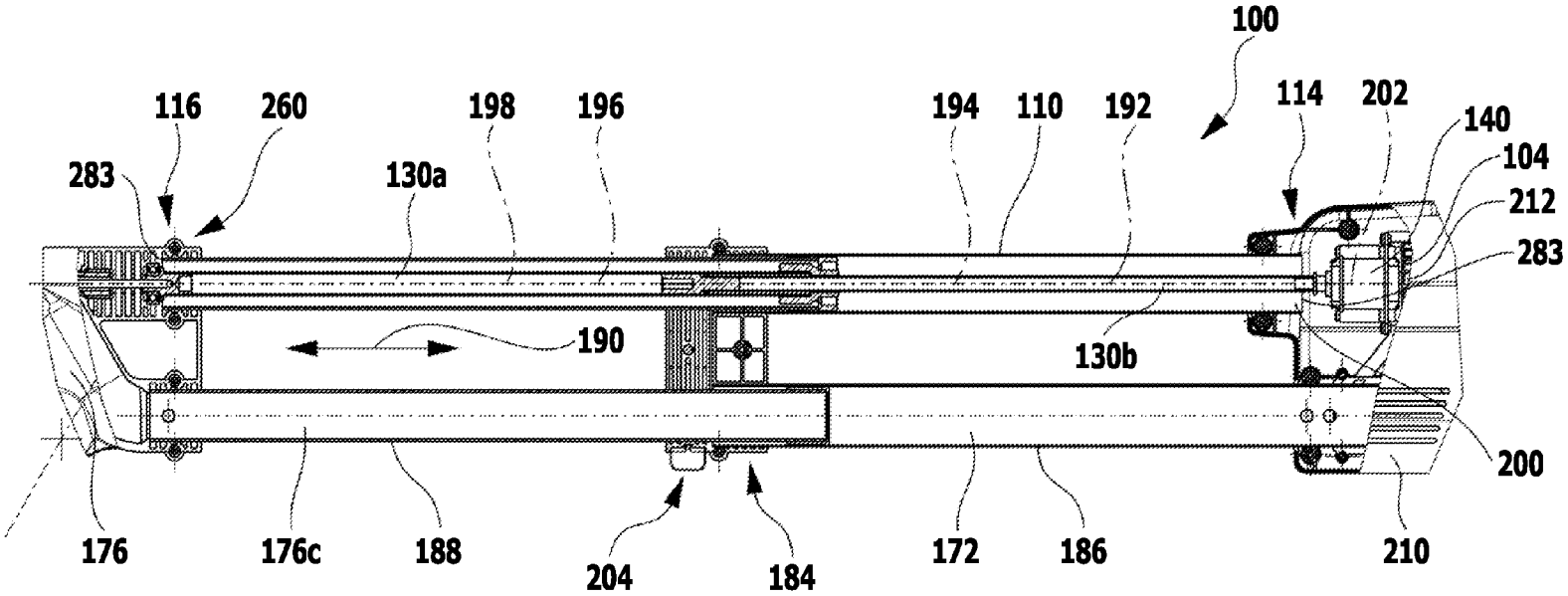
FIG. 9 an enlarged illustration of the region IX in FIG. 8.

As can be derived in particular from FIGS. 7 and 9, the drive motor 104 of the abrading machine 100 in accordance with the first embodiment is arranged directly behind an end 200 of the tubular bar 110 towards the drive motor 104, i.e. behind the proximal end 114 of the tubular bar 110.

Thereby, the drive motor 104 is coupled to the transmission shaft 130 by means of a gear unit 140 and in particular a planetary gear 142.

A motor shaft rotational axis 202 of the drive motor 104 and a transmission shaft rotational axis 192 within the tubular bar 110 are substantially identical thereby.

Commencing from the drive motor 104, the transmission shaft 130 is fed into the tubular bar 110 at the proximal end 114 of the tubular bar 110 through an opening 283 in the tubular bar 110 which forms a base area of the tubular bar 110, and/or is fed out of the tubular bar 110 at the distal end 116 of the tubular bar 110 through an opening 283 in the tubular bar 110 which forms a base area of the tubular bar 110.

The spacing of the drive motor 104 from the tool head 108 is preferably continuously adjustable by means of the telescopic device 184.

The abrading machine 100 comprises a locking device 204 for locking the drive motor 104 relative to the tool head 108 and in particular for establishing a desired length of the abrading machine 100.

The locking device 204 can, for example, be in the form of a latching device and/or a clamping device particularly in order to fix the inner parts 188 and the outer parts 186 of the tubing elements 112 relative to each other taken with respect to the extension direction 190.

The previously described first embodiment of the handheld abrading machine 100 functions as follows.

Before starting the abrading machine 100, a desired length of the abrading machine 100 and therefore a desired spacing of the drive motor 104 from the tool head 108 are set by means of the telescopic device 184.

The tool head 108 is fixed at the desired spacing from the drive motor 104 by means of the locking device 204.

A tool 106 is now arranged on the tool holder 132.

Thereby, the tool holder 132 and the tool 106 are connected to one another by means of a hook and loop fastening for example.

In order to start the abrading machine 100, a user grips the abrading machine 100 by the holding device 102 and in particular, by a handle element 206 and also by the engagement region 208 of the abrading machine 100.

In particular, the handle element 206 is arranged on the housing 210 for the drive motor 104.

The engagement region 208 is arranged, in particular, on the tubular bar 110.

The handle element 206 and the engagement region 208 are preferably arranged on mutually opposite sides of the drive motor 104.

If, now, the drive motor 104 is switched on, then a motor shaft 212 of the drive motor 104 is set into rotational movement.

The motor shaft 212 is coupled to the transmission shaft 130 and transfers the rotational movement by means of the transmission shaft 130 to the tool holder 132 which is coupled to the transmission shaft 130 by means of the coupling device 138.

The tool holder 132 and the tool 106 arranged thereon are thus set into rotational movement.

The gear units 140, namely, the gear unit of the coupling device 138 and the gear unit 140 arranged between the drive motor 104 and the transmission shaft 130 are reduction gears such as a planetary gear 142 for example, and they reduce the number of revolutions of the motor shaft 212 to a desired number of revolutions of the tool holder 132 and thus of the tool 106.

An abrading action can be effected by means of the rotating tool 106.

For this purpose, the abrading machine 100 together with the tool 106 is placed on a surface that is to be treated such as a wall, a floor or a ceiling for example.

The surface is abraded by the rotation of the tool 106.

Abraded material is produced thereby and this can heavily contaminate the environment unless suitably exhausted.

In the case of the handheld abrading machine 100 in accordance with FIGS. 1 to 9, the suction device 170 is provided for the purposeful removal of the abraded material.

To this end, the abraded material resulting from the treatment of the surface is held in the hood chamber 160 by means of the sealing device 161 of the hood device 156 of the tool head 108. The abraded material is removed from the hood chamber 160 and in particular, is sucked out via the suction channel 172 and supplied to a suitable disposal facility.

In particular, the abraded material is removed continuously from the hood chamber 160 by means of the ring-shaped or ring-section-shaped suction channel section 176*a*.

Subsequently, the abraded material removed through the ring-shaped or ring-section-shaped suction channel section 176*a* is supplied via the transition section 178 to the flexible suction channel section 176*b*, from there it is guided via the fork-piece 182 into the tubular suction channel section 176*c*, removed from the abrading machine 100 via the connector device 174 and preferably supplied to the (not illustrated) suction device.

Due to the use of the planetary gear 142, the abrading machine 100 is particularly smooth running so that a simple, efficient and as fatigue-free an abrading process as possible is obtained.

Figure 12:
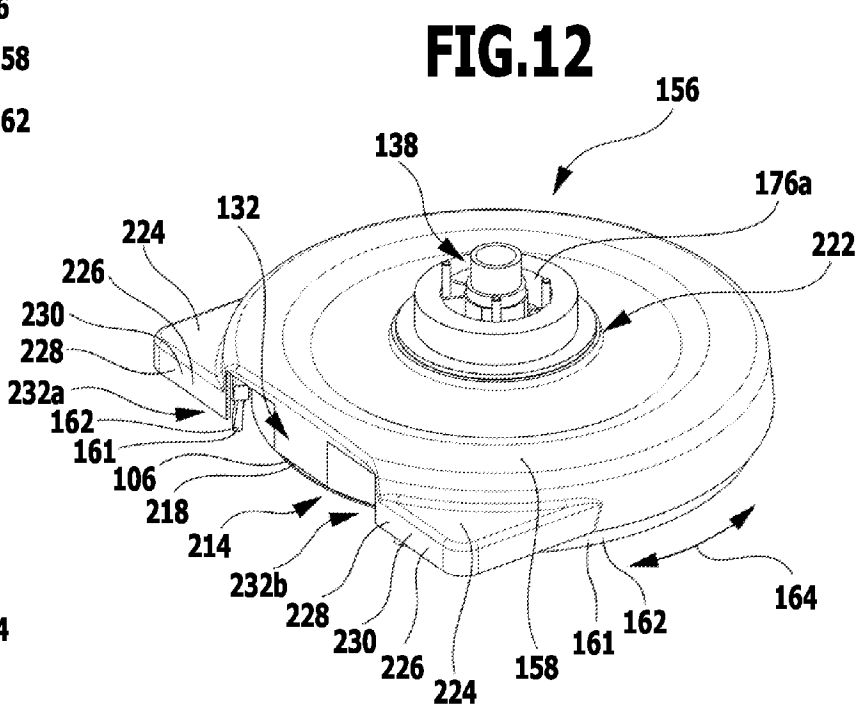
FIG. 12 a schematic perspective illustration of the tool head depicted in FIG. 10.
Figure 10:
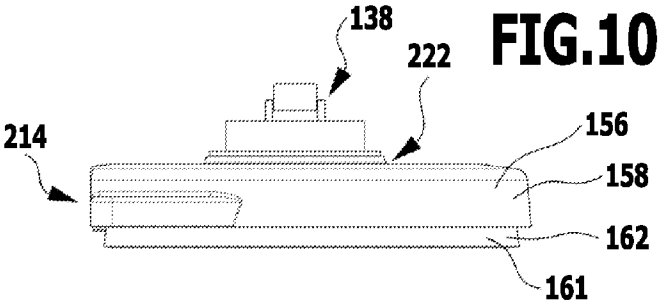
FIG. 10 a schematic side view of a tool head of a second embodiment of an abrading machine in which a hood device incorporating a recess in the form of a segment of a cylinder is provided.
Figure 11:
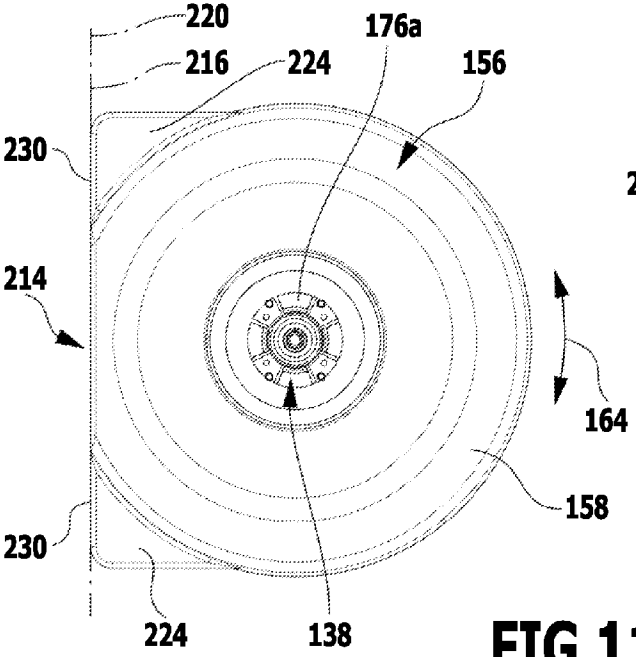
FIG. 11 a schematic plan view of the tool head depicted in FIG. 10.

A second embodiment of a handheld abrading machine 100 which is illustrated in FIGS. 10 to 12 differs from the first embodiment illustrated in FIGS. 1 to 9 mainly in that that the hood device 156 comprises a hood element 158 which has a recess 214.

The recess 214 is, in particular, substantially in the form of a segment of a cylinder.

As can be derived in particular from FIGS. 11 and 12, a plane 216 delimiting the recess 214 is oriented substantially parallel to the rotational axis 154 of the tool holder 132.

Thereby, the plane 216 is arranged and the recess 214 is thus dimensioned in such a way that a tangent 220 touching an edge 218 of the tool 106 runs at least approximately in the plane 116.

As follows in particular from a comparison of FIGS. 3 and 12, the recess 214 in the hood element 158 makes it possible for the tool 106 to closely approach an edge region or corner region of two walls for example.

Without such a recess 214, an edge region between two walls would not be treatable by means of the abrading machine 100. Rathermore, for this purpose, a separate treatment would have to be carried out in this edge region by hand or by means of another abrading machine.

The hood element 158 is arranged on the central element 134 and in particular on the housing 136 such as to be rotatable about the rotational axis 154. Thereby, the tool head 108 can be guided comfortably along an edge region or a corner region of a surface that is to be treated substantially independently of the orientation of the rest of the abrading machine 100.

In order to prevent unwanted twisting of the hood element 158, the hood device 156 comprises a braking device 222.

The braking device 222 may, for example, comprise a spring device, a friction device or a latching device in order to hold the hood element 158 of the hood device 156 in a desired position.

Furthermore, the hood device 156 comprises two contact elements 224.

The contact elements 224 form contact sections 226 of the hood device 156 for the lateral placement and guidance of the hood element 158 on an edge region or along an edge region for example in the transition area between two walls.

Thereby, the contact sections 226 have surfaces 228 which run at least approximately in the plane 216 and contact surfaces 230 for the placement of the hood element 158.

The contact elements 224 and/or the contact sections 226 can be formed in one-piece manner with the hood element 158 (see in particular FIG. 12). As an alternative thereto, provision may be made for the contact elements 224 and/or the contact sections 226 to be separate elements that are connected to the hood element 158 for example.

As can be derived in particular from FIG. 12, the sealing ring 165 of the sealing device 161 and in particular, the brush collar 166 of the brush device 162 is not a closed ring due to the recess 214.

Rathermore, the sealing device 161 of the hood element 158 only extends from one side 232*a* of the recess 214 along the peripheral direction 164 of the hood element 158 up to the side 232*b* of the recess 214 that is located opposite to the side 232*a*.

The recess 214 can thus lead to abraded material that is present in the hood chamber 160 escaping into the environment.

This however, can be prevented by a suitably dimensioned exhaust process.

In all other respects, the second embodiment of the handheld abrading machine 100 that is illustrated in FIGS. 10 to 12 corresponds in regard to the construction and functioning thereof with the first embodiment illustrated in FIGS. 1 to 9, and insofar, reference should be made to the previous description thereof.

A third embodiment of a handheld abrading machine 100 which is illustrated in FIGS. 13 to 18 differs from the second embodiment illustrated in FIGS. 10 to 12 mainly in that that the hood device 156 comprises a cover element 234 for covering the recess 214.

Thereby, the cover element 234 is arranged on the hood element 158 in hinged or pivotal manner for example.

In particular thereby, a pivotal axis 236 of the cover element 234 is arranged substantially perpendicularly to the rotational axis 154 and is spaced therefrom.

Figure 15:
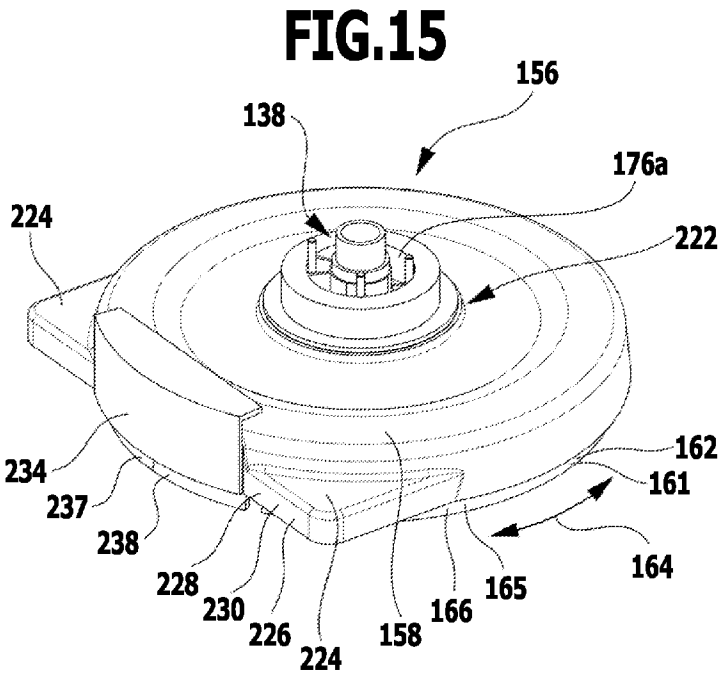
FIG. 15 a schematic perspective illustration corresponding to FIG. 12 of the tool head depicted in FIG. 13.
Figure 18:
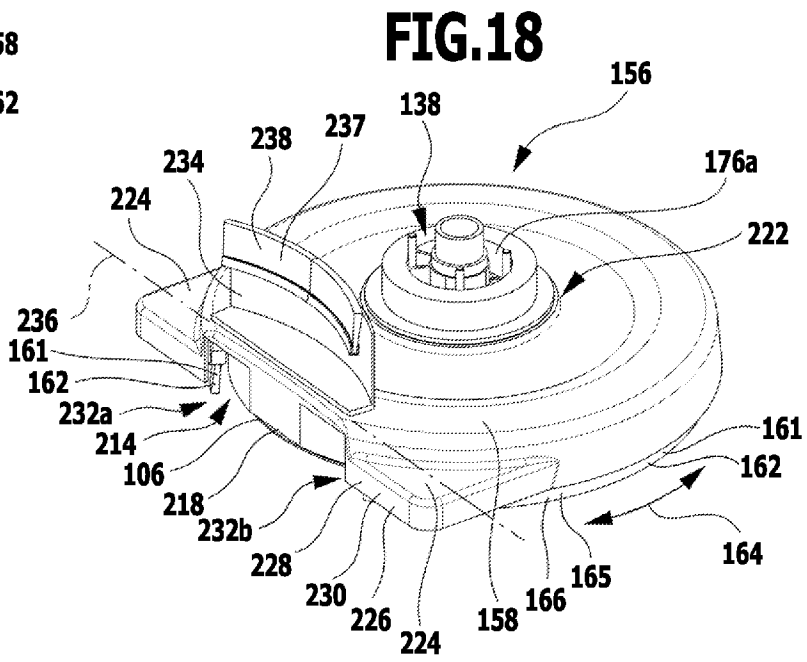
FIG. 18 a schematic perspective illustration corresponding to FIG. 15 of the tool head depicted in FIG. 16.

As can be derived in particular from FIGS. 15 and 18, the cover element 134 comprises a sealing device 237, in particular, a brush device 238.

Figure 13:
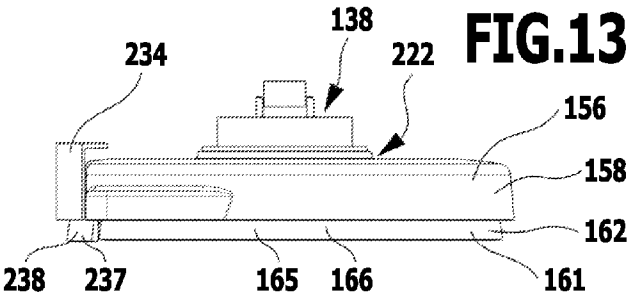
FIG. 13 a schematic side view corresponding to FIG. 10 of a tool head of a third embodiment of an abrading machine in which the hood device comprises a cover element for covering the recess, wherein the cover element is arranged in a covering position.
Figure 14:
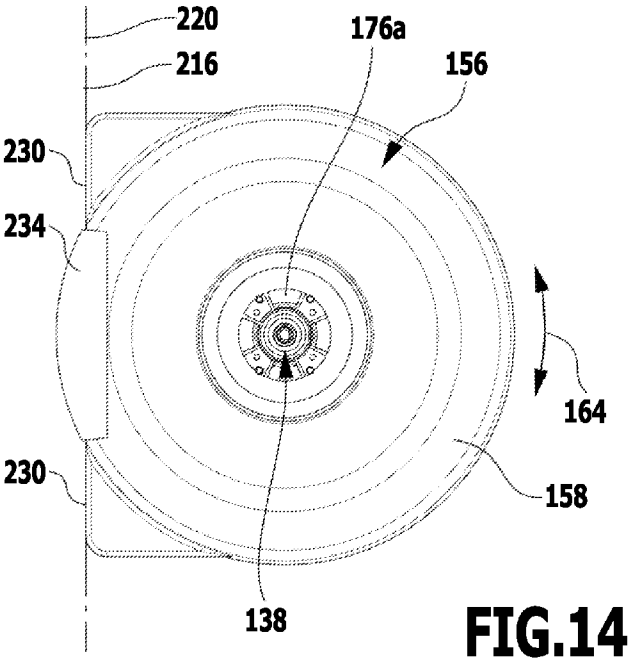
FIG. 14 a schematic illustration corresponding to FIG. 11 of the tool head depicted in FIG. 13.

Thereby, the sealing device 237 of the cover element 234 is formed in such a way that the sealing device 161 of the hood element 158 is supplemented by means of the sealing device 237 of the cover element 234 so as to form a substantially complete sealing ring 165 and in particular, a substantially complete ring-shaped brush collar 166 in the covering position of the cover element 234 illustrated in FIGS. 13 to 15.

In the covering position illustrated in FIGS. 13 to 15, the hood chamber 160 is preferably substantially closed by means of the cover element 234.

Thus, in the covering position of the cover element 234, unwanted escape of abraded material from the hood chamber 160 can be prevented effectively.

Figure 16:
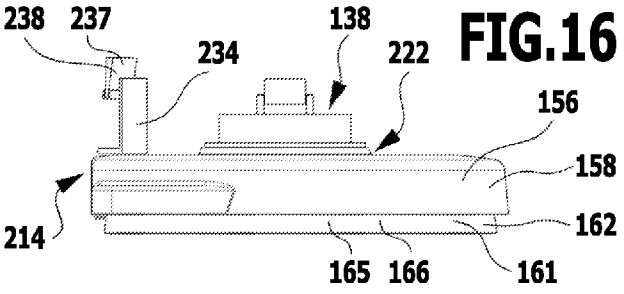
FIG. 16 a schematic illustration corresponding to FIG. 13 of the tool head depicted in FIG. 13, wherein the cover element is arranged in an open position.
Figure 17:
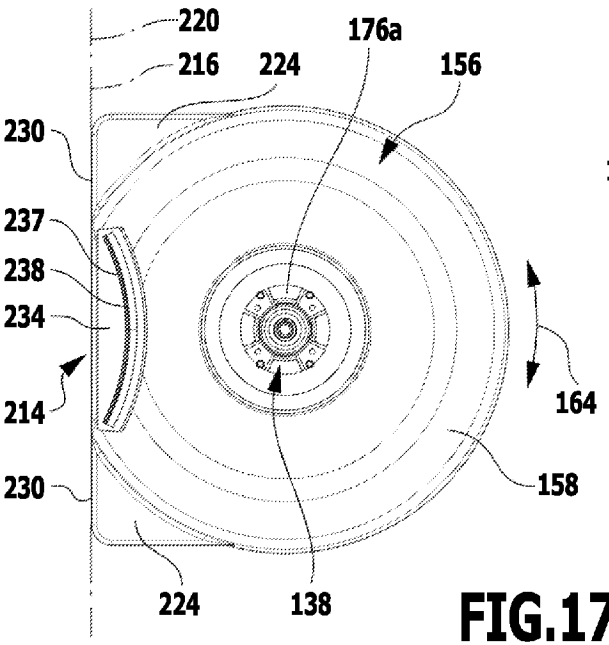
FIG. 17 a schematic illustration corresponding to FIG. 14 of the tool head depicted in FIG. 16.

In the covering position of the cover element 234, the handheld abrading machine 100 is suitable, in particular, for the treatment of larger surfaces. In order to enable edge regions to be treated, the cover element 234 can then be moved into the open position that is illustrated in FIGS. 16 to 18.

In all other respects, the third embodiment of the handheld abrading machine 100 that is illustrated in FIGS. 13 to 18 corresponds in regard to the construction and functioning thereof with the second embodiment illustrated in FIGS. 10 to 12 and/or with the first embodiment illustrated in FIGS. 1 to 9, and insofar, reference should be made to the previous descriptions thereof.

A fourth embodiment of a handheld abrading machine 100 which is illustrated in FIGS. 19 to 24 differs from the third embodiment illustrated in FIGS. 13 to 18 mainly in that that the cover element 234 is arranged on the central element 134 and in particular, on the housing 136 of the tool head 108 and is rotatable about the rotational axis 154.

Figure 21:
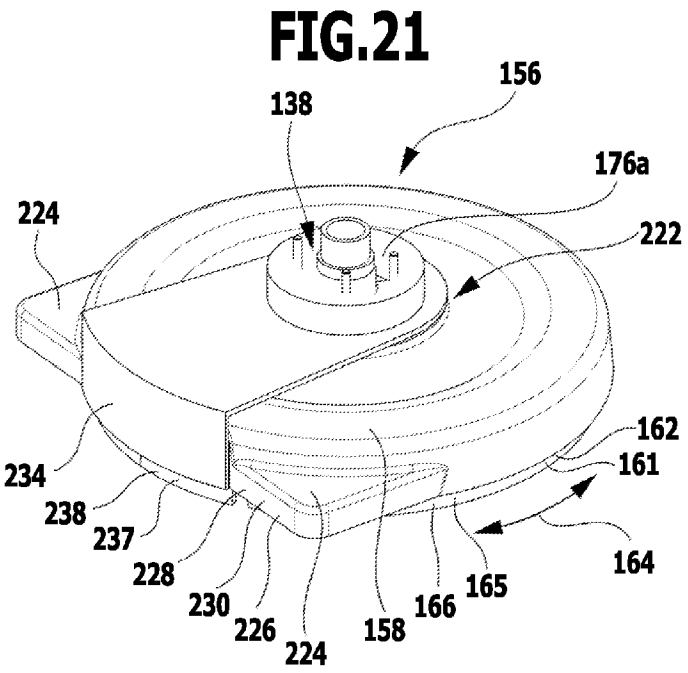
FIG. 21 a schematic perspective illustration corresponding to FIG. 15 of the tool head depicted in FIG. 19.
Figure 19:
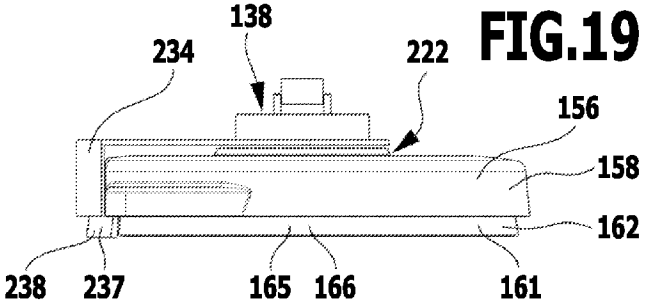
FIG. 19 a schematic side view corresponding to FIG. 13 of a tool head of a fourth embodiment of an abrading machine in which, in place of a hinged cover element, a rotatable cover element is arranged in a covering position.
Figure 20:
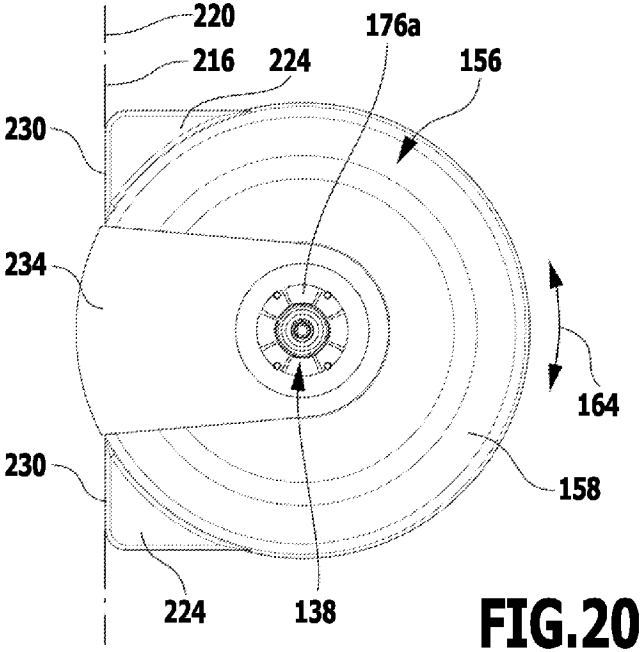
FIG. 20 a schematic illustration corresponding to FIG. 14 of the tool head depicted in FIG. 19.
Figure 24:
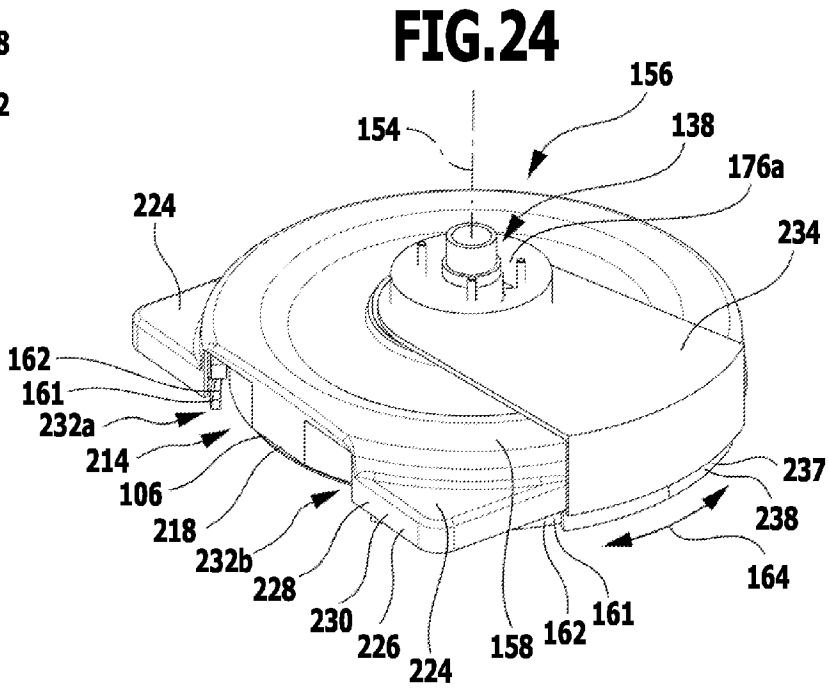
FIG. 24 a schematic perspective illustration corresponding to FIG. 21 of the tool head depicted in FIG. 22.
Figure 22:
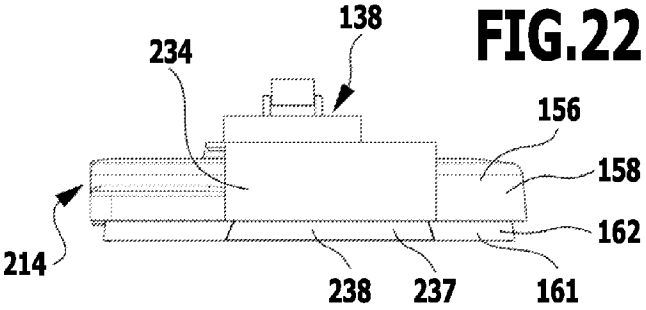
FIG. 22 a schematic side view corresponding to FIG. 19 of the tool head of the fourth embodiment of the abrading machine, wherein the cover element is arranged in an open position.
Figure 23:
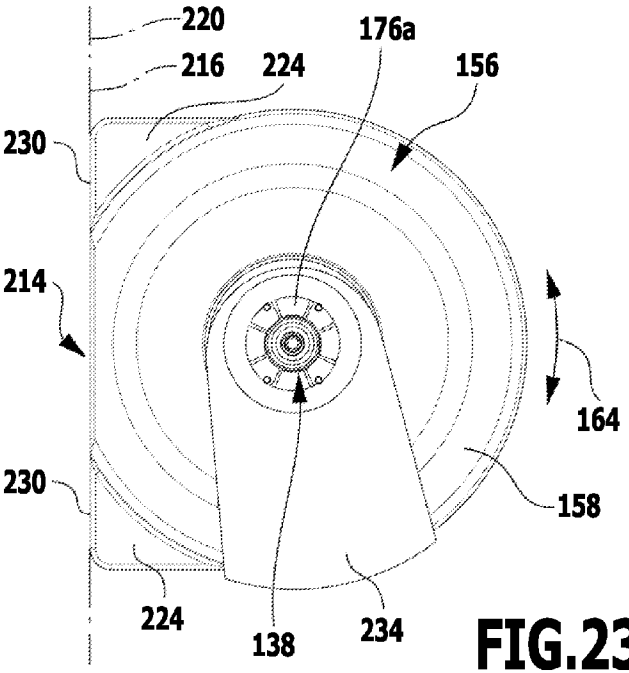
FIG. 23 a schematic plan view corresponding to FIG. 20 of the tool head depicted in FIG. 22.

The cover element 234 is preferably flexible in order to enable it to be moved past the contact elements 224 from the covering position illustrated in FIGS. 19 to 21 into the open position illustrated in FIGS. 22 to 24 and back again.

In all other respects the fourth embodiment of the handheld abrading machine 100 that is illustrated in FIGS. 19 to 24 corresponds in regard to the construction and functioning thereof with the third embodiment illustrated in FIGS. 13 to 18, and insofar, reference should be made to the previous description thereof.

In a (not illustrated) further embodiment of a handheld abrading machine 100, the cover element 234 is arranged on the hood element 158 such as to be removable in order to enable it to be placed selectively in the covering position or in the open position.

Figure 25:
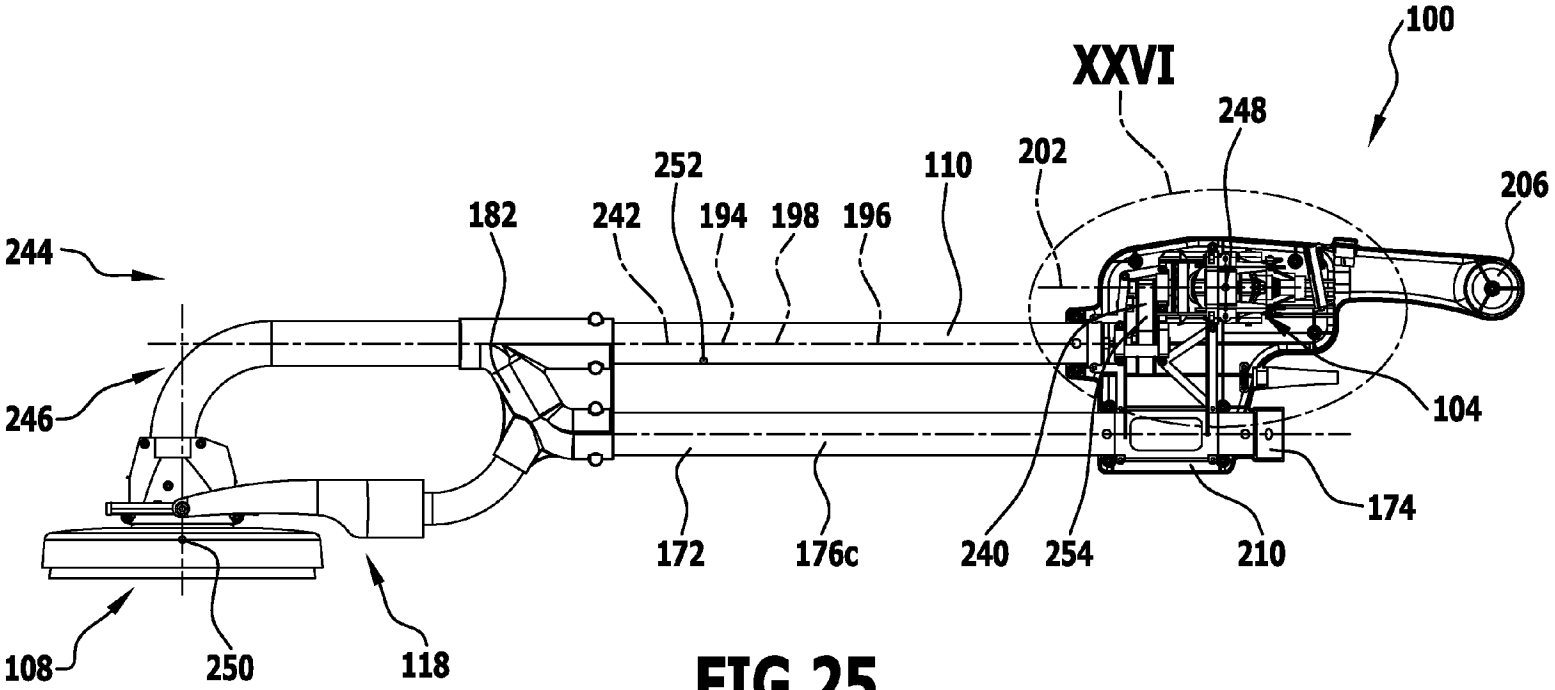
FIG. 25 a partly sectional side view corresponding to FIG. 6 of a fifth embodiment of an abrading machine in which an offsetting device is provided between a drive motor and a transmission shaft of the abrading machine, wherein the offsetting device comprises a toothed belt device.
Figure 26:
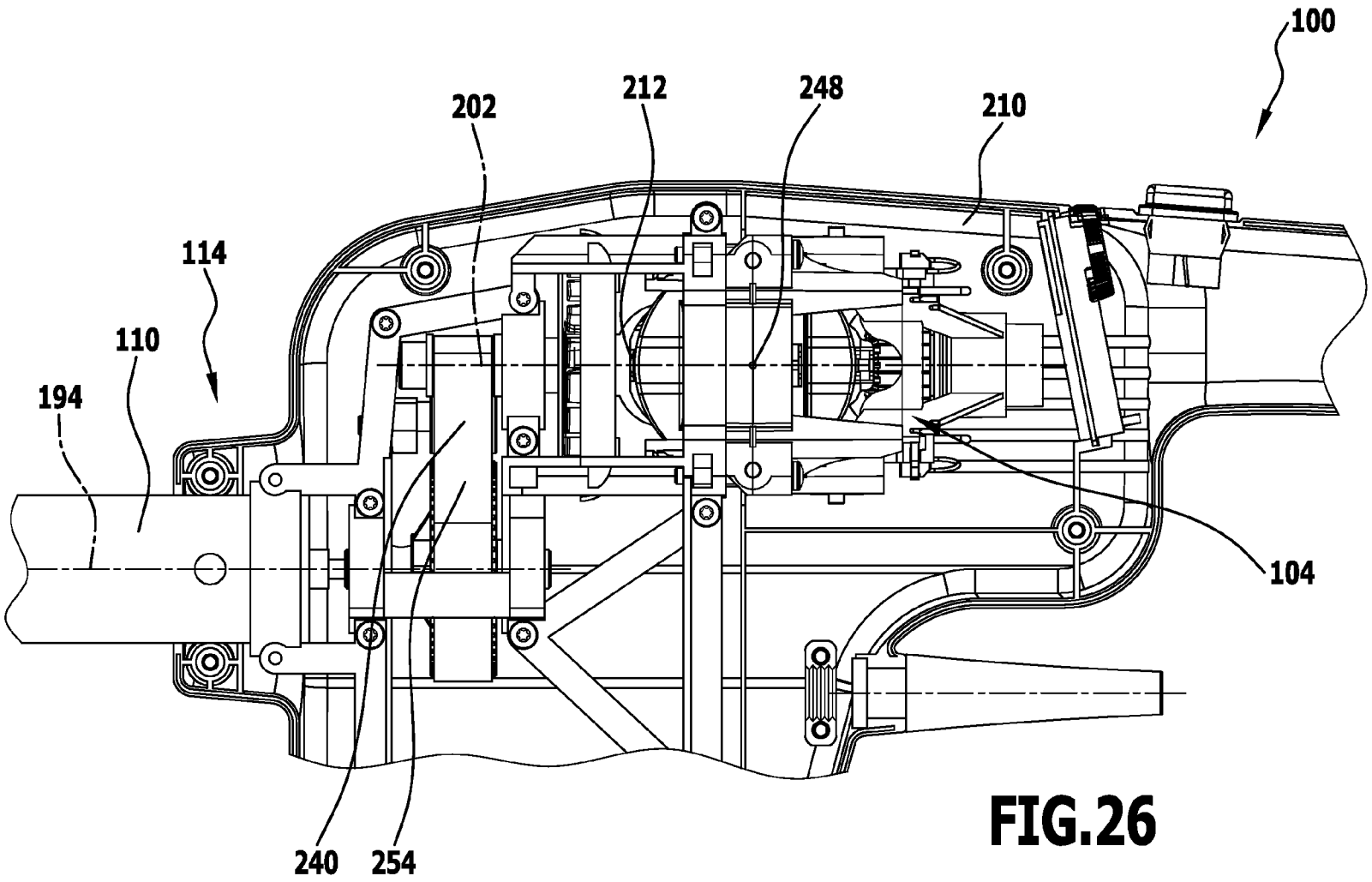
FIG. 26 an enlarged illustration of the region XXVI depicted in FIG. 25.

A fifth embodiment of a handheld abrading machine 100 which is illustrated in FIGS. 25 and 26 differs from the first embodiment illustrated in FIGS. 1 to 9 mainly in that the drive motor 104 is coupled to the transmission shaft 130 by means of an offsetting device 240.

The motor shaft rotational axis 202 and the transmission shaft rotational axis 192 are arranged such that they are parallel to each other but at the same time, they are offset and especially spaced from one another.

Furthermore, the motor shaft rotational axis 202 is arranged such as to be parallel to and spaced from the longitudinal axis 194 of the tubular bar 110.

As can be derived in particular from FIG. 25, the abrading machine 100 can be sub-divided into a motor side 244 and a tool side 246 with respect to a longitudinal plane 242 in which the longitudinal axis 194 of the tubular bar 110 runs and which is oriented substantially perpendicularly to a plane defined by the symmetry axes 198 of the tubing elements 112.

The drive motor 104 is arranged on the motor side 244 of the abrading machine 100.

The tool head 108 is arranged on the tool side 246.

In particular, a center of gravity 248 of the drive motor 104 is located on the motor side 244. A center of gravity 250 of the tool head 108 is preferably arranged on the tool side 246.

The drive motor 104 and the tool head 108 are preferably arranged on mutually opposite sides of the longitudinal axis 194 of the tubular bar 110, in particular, of the longitudinal plane 242.

Thereby, a center of gravity 252 of the abrading machine 100 can preferably be set particularly close to the tubular bar 110 and in particular, in the tubular bar 110.

The abrading machine 100 is thereby easy to handle and provides a simple, efficient and as fatigue-free an abrading action as possible.

As can be derived in particular from FIG. 26, the offsetting device 240 is in the form of a toothed belt device 254.

The toothed belt device 254 can function as a gear unit 140 and, as such, enables in particular a reduction to be effected during the transmission of the rotational movement of the drive motor 104 to the transmission shaft 130.

In all other respects the fifth embodiment of the handheld abrading machine 100 that is illustrated in FIGS. 25 and 26 corresponds in regard to the construction and functioning thereof with the first embodiment illustrated in FIGS. 1 to 9 so that reference should be made to the previous description thereof.

Furthermore, provision may be made for the fifth embodiment of the abrading machine 100 that is illustrated in FIGS. 25 and 26 to comprise a hood device 156 in accordance with the embodiments two, three or four of the abrading machine 100.

Figure 27:
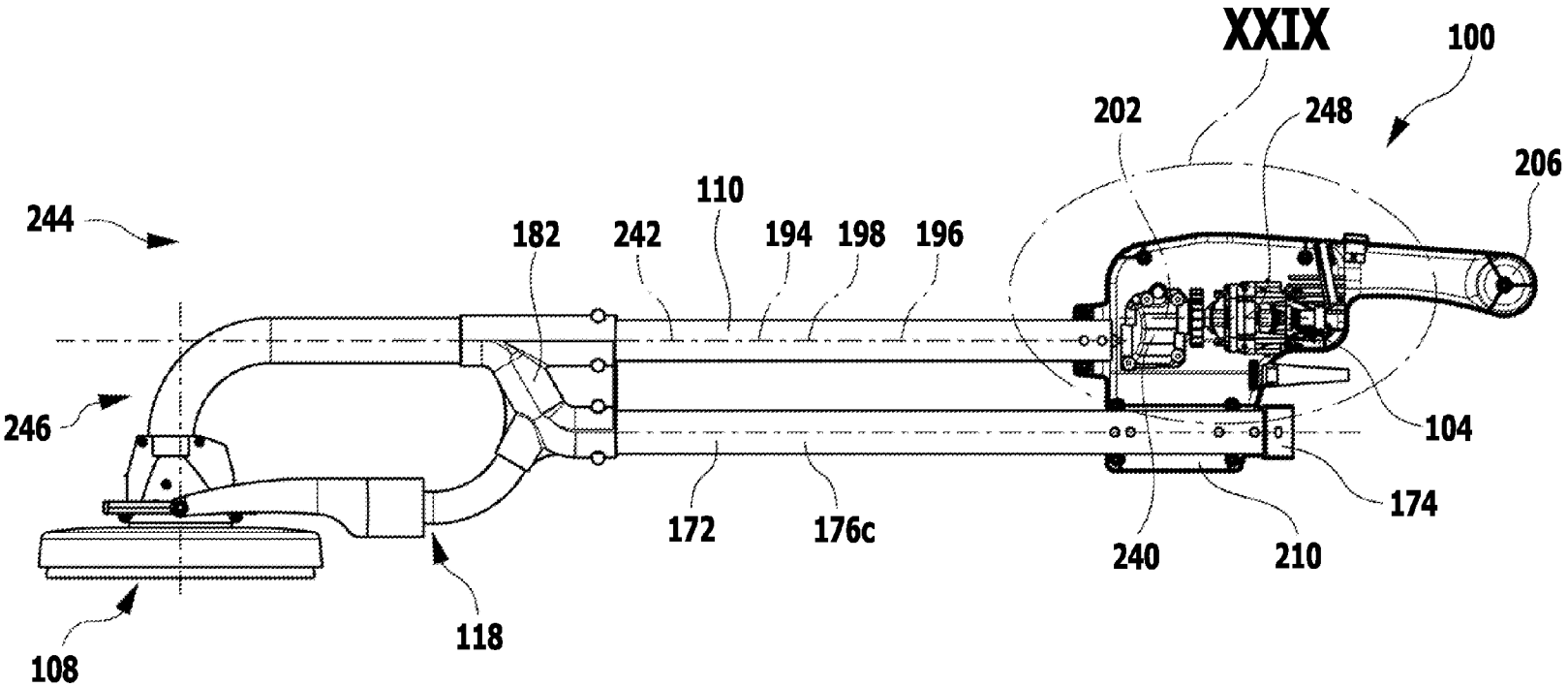
FIG. 27 a partly sectional side view corresponding to FIG. 6 of a sixth embodiment of an abrading machine in which an offsetting device in the form of a gear wheel device is provided.
Figure 28:
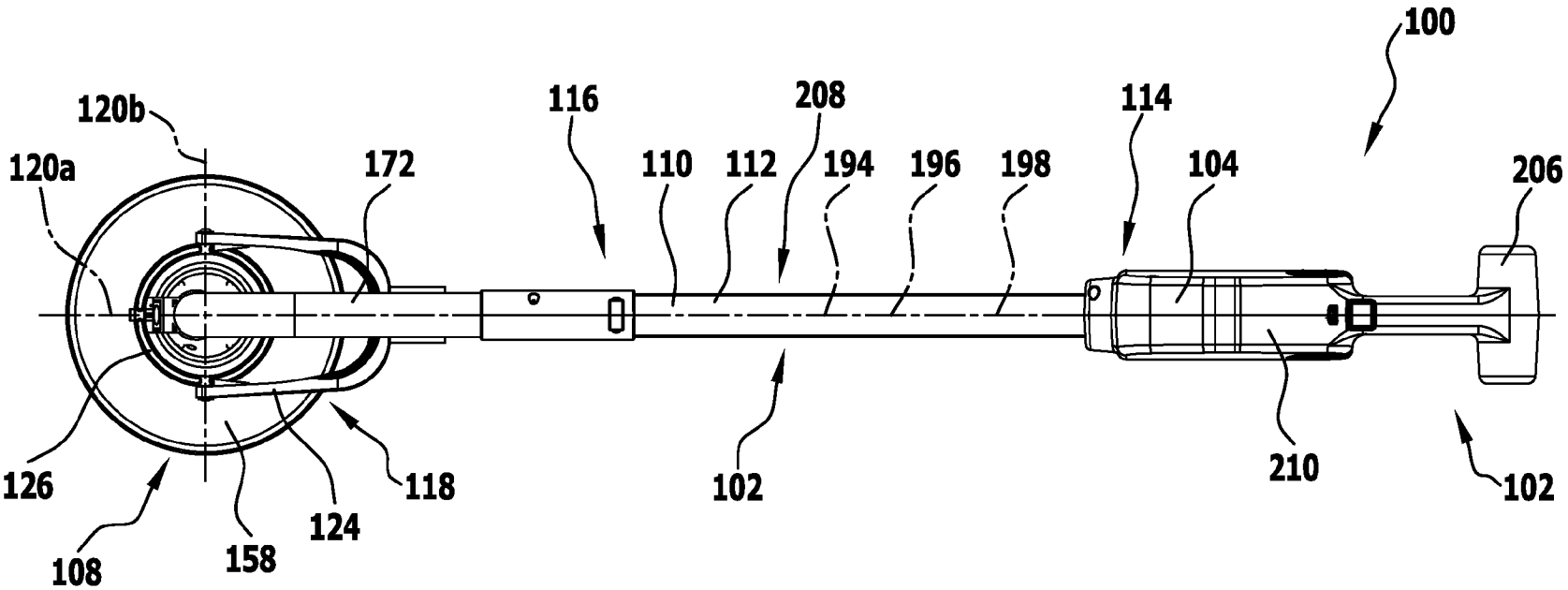
FIG. 28 a schematic plan view of the abrading machine in accordance with FIG. 27.
Figure 29:
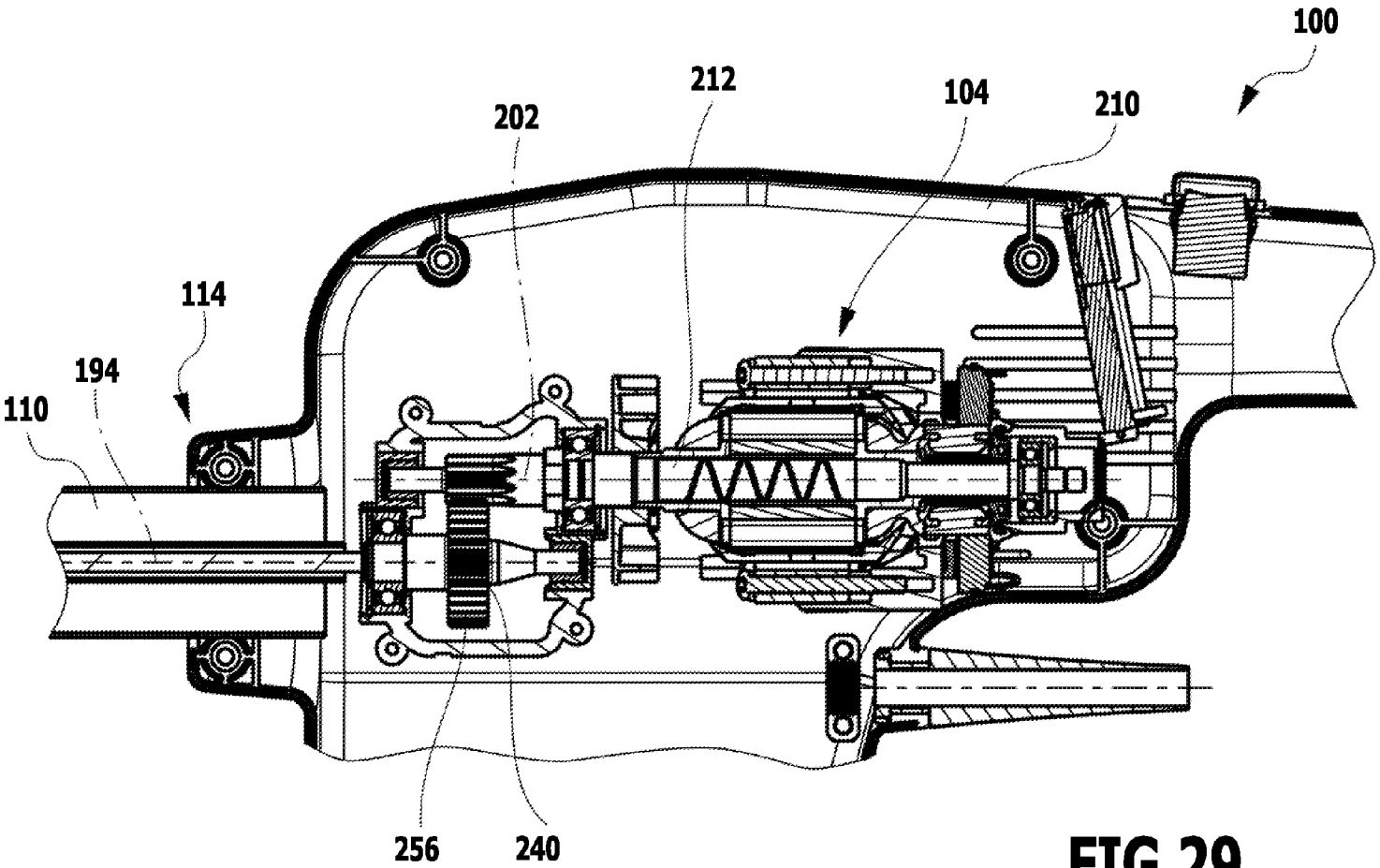
FIG. 29 an enlarged illustration of the region XXIX in FIG. 27.

A sixth embodiment of a handheld abrading machine 100 which is illustrated in FIGS. 27 to 29 differs from the fifth embodiment illustrated in FIGS. 25 and 26 mainly in that the offsetting device 240 is in the form of a gear wheel device 256.

In all other respects the sixth embodiment of the handheld abrading machine 100 that is illustrated in FIGS. 27 to 29 corresponds in regard to the construction and functioning thereof with the fifth embodiment described in the FIGS. 25 and 26 or the embodiments one to four described in FIGS. 1 to 24, and insofar, reference should be made to the previous descriptions thereof.

Figure 30:
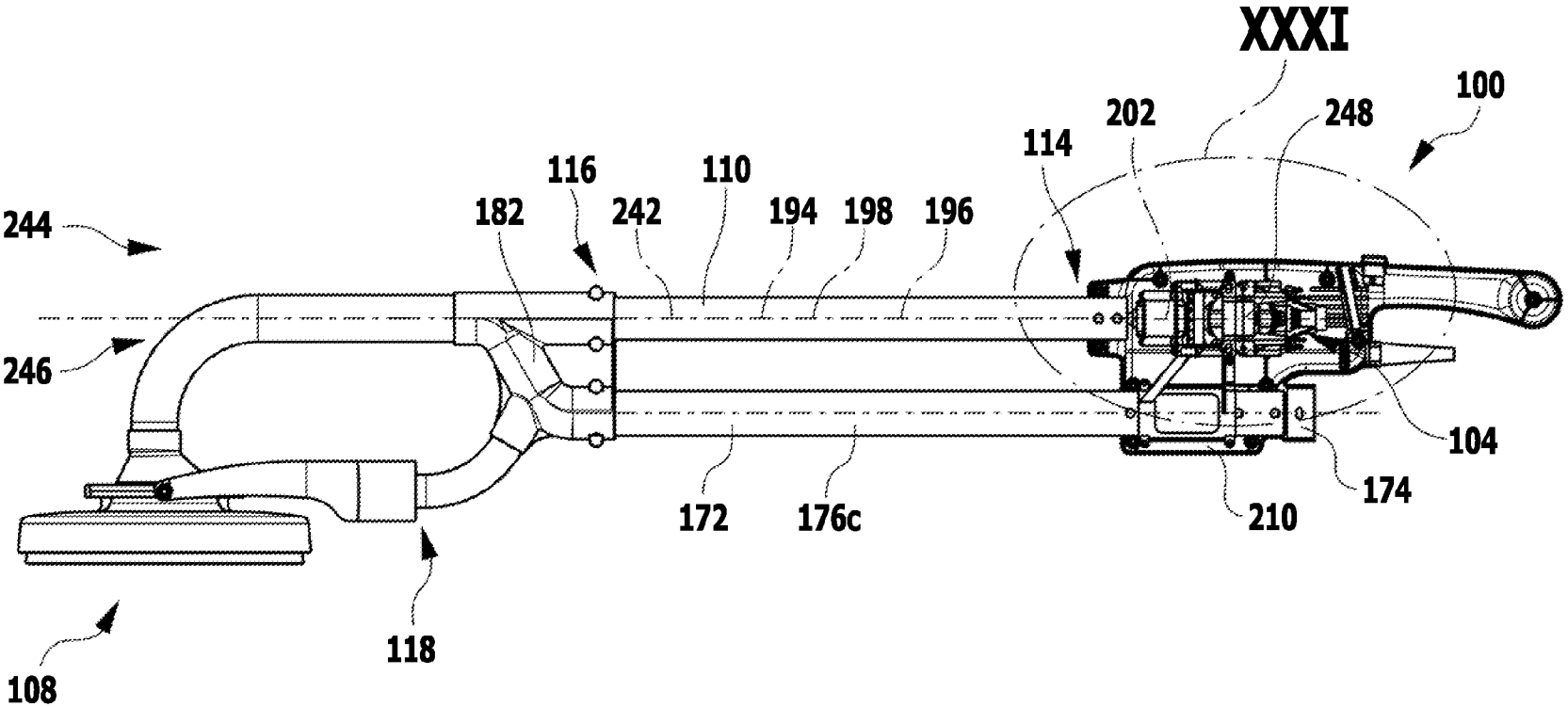
FIG. 30 a partly sectional side view corresponding to FIG. 6 of a seventh embodiment of an abrading machine in which a telescopic arrangement is not provided.
Figure 31:
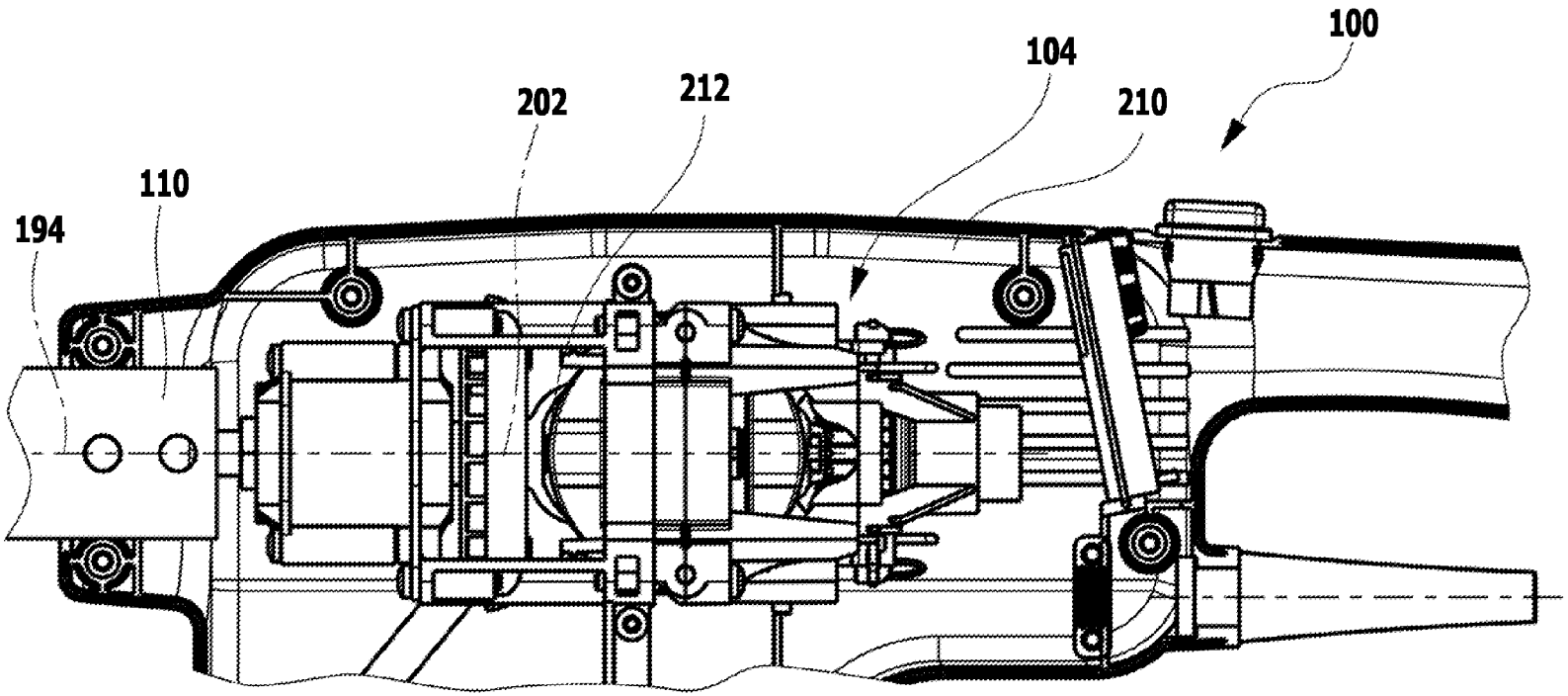
FIG. 31 an enlarged illustration of the region XXXI in FIG. 30.
Figure 32:
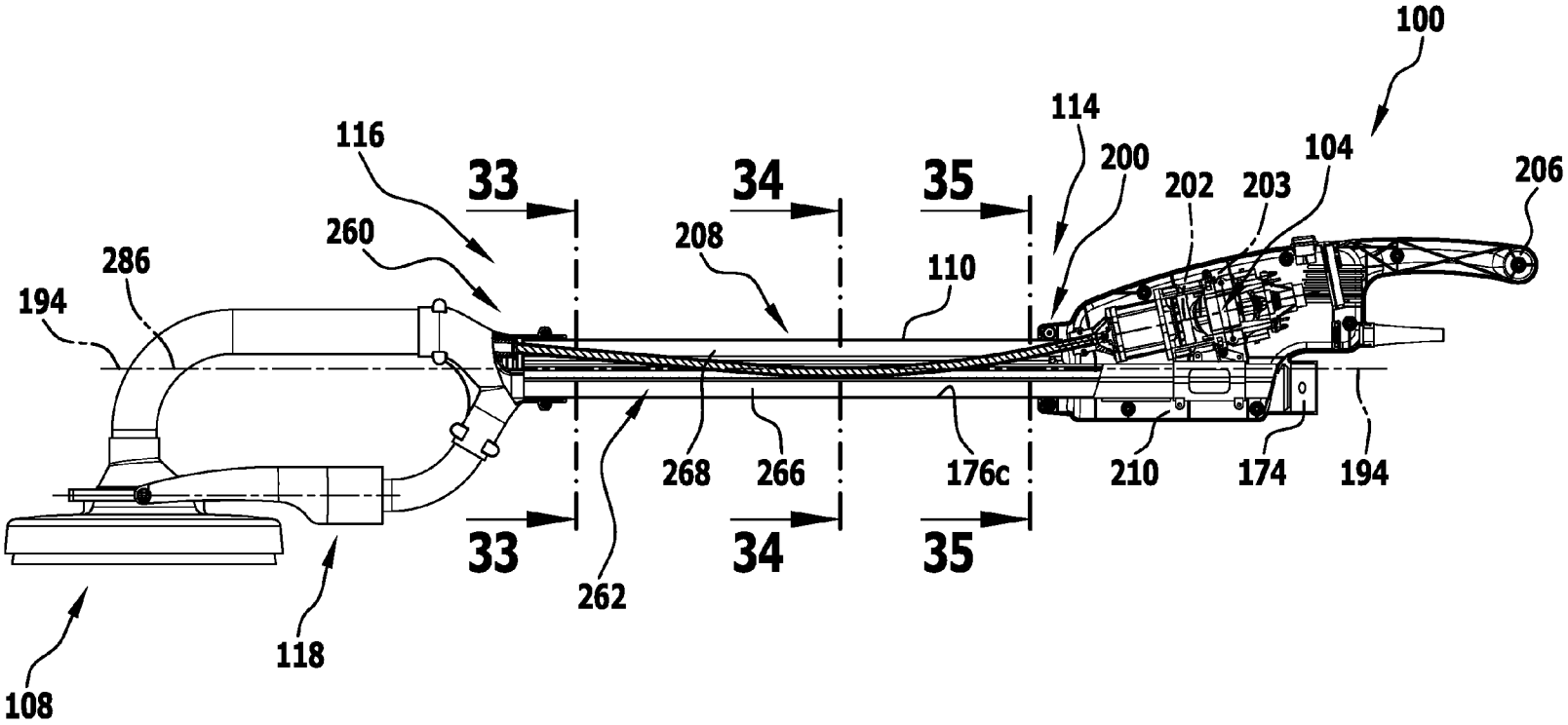
FIG. 32 a partly sectional side view corresponding to FIG. 6 of an eighth embodiment of an abrading machine in which a motor shaft rotational axis is oriented transversely to a longitudinal axis of a tubular bar of the abrading machine.
Figure 35:
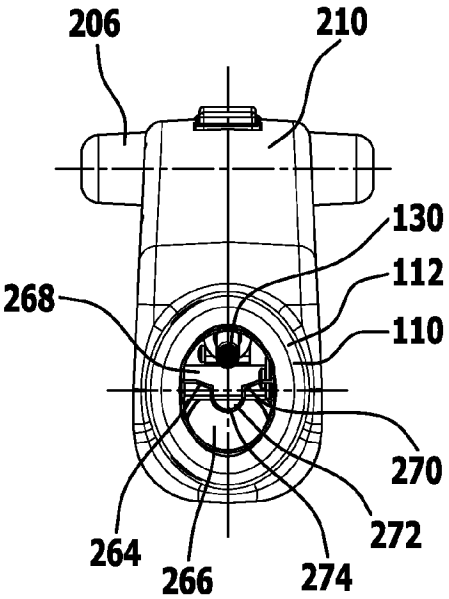

A seventh embodiment of a handheld abrading machine 100 which is illustrated in FIGS. 30 and 31 differs from the first embodiment illustrated in FIGS. 1 to 9 mainly in that no telescopic device 184 is provided.

Consequently, the spacing between the drive motor 104 and the tool head 108 is always constant in the seventh embodiment illustrated in FIGS. 30 and 31.

In all other respects, the seventh embodiment of the handheld abrading machine 100 that is illustrated in FIGS. 30 and 31 corresponds in regard to the construction and functioning thereof with the first embodiment illustrated in FIGS. 1 to 9, and insofar, reference should be made to the previous description thereof.

However, provision could also be made for the seventh embodiment of the handheld abrading machine 100 which is illustrated in FIGS. 30 and 31 to incorporate particular ones or a plurality of the features of the other embodiments.

An eighth embodiment of a handheld abrading machine 100 which is illustrated in FIGS. 32 to 35 from the first embodiment illustrated in FIGS. 1 to 9 mainly in that the drive motor 104 and the tool head 108 are connected to one another by only one tubing element 112, namely, the tubing element 112 forming the tubular bar 110.

A telescopic device 184 is not provided.

In the case of the eighth embodiment of the handheld abrading machine 100 that is illustrated in FIGS. 32 to 35, the motor shaft rotational axis 202 is oriented transversely with respect to the longitudinal axis 194 of the tubular bar 110.

In particular, the motor shaft rotational axis 202 and the longitudinal axis 194 of the tubular bar 110 include an angle of approximately 12° therebetween.

The motor shaft rotational axis 202 is a motor shaft rotational axis 203 which is oriented transversely to the longitudinal axis 194 of the tubular bar 110.

The transmission shaft 130 is flexible at least in the region of the tubular bar 110 and is bent or curved in the tubular bar 110.

The transmission shaft 130 is fed into the tubular bar 110 transversely relative to the longitudinal axis 194 of the tubular bar 110 at the end 200 of the tubular bar 110 towards the drive motor 104, i.e. at the proximal end 114 of the tubular bar 110.

The transmission shaft 130 is fed out of the tubular bar 110 in a direction running transversely relative to the longitudinal axis 194 of the tubular bar 110 at an end 260 of the tubular bar 110 towards the tool head 108, i.e. at the distal end 116 of the tubular bar 110.

An interior space 262 of the tubular bar 110 is split in two by means of a partition wall 264.

Thereby, an interior space part 266 serves for accommodating and for the guidance of the transmission shaft 130.

A further interior space part 268 serves as a tubular suction channel section 176*c*.

Figure 34:
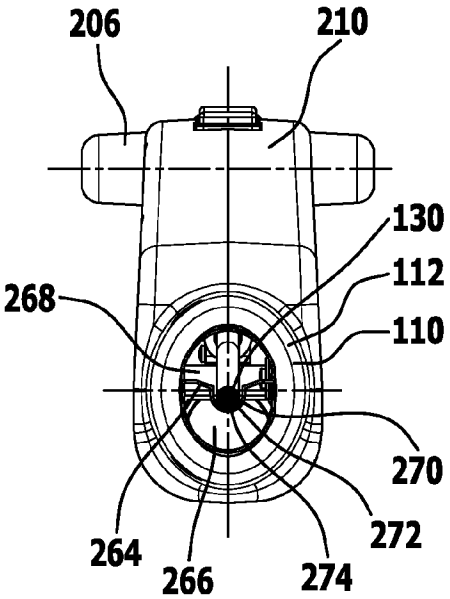
FIG. 34 a vertical cross section through the tubular bar of the abrading machine depicted in FIG. 32 along the line 34-34 in FIG. 32, FIG. 35 a vertical cross section through the tubular bar of the abrading machine depicted in FIG. 32 along the line 35-35 in FIG. 32.
Figure 33:
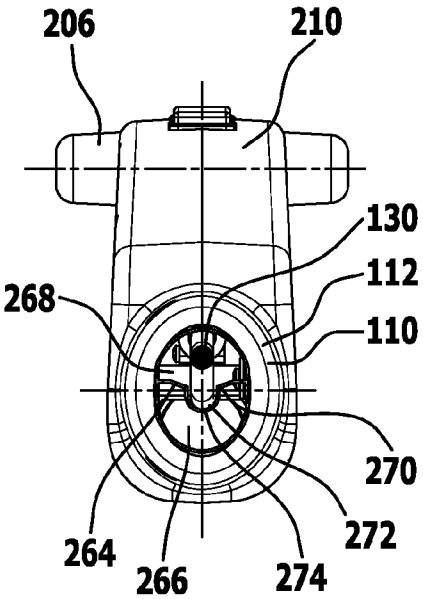
FIG. 33 a vertical cross section through the tubular bar of the abrading machine depicted in FIG. 32 along the line 33-33 in FIG. 32.

In the interior space 262 of the tubular bar 110, there is arranged at least one guide element 270, in particular, a guide channel 272 for the guidance of the transmission shaft 130 (see in particular FIG. 34).

The guide element 270 and in particular, the guide channel 272 can be formed by a groove 274 arranged in the partition wall 264 for example.

In the case too of the eighth embodiment of the handheld abrading machine 100 that is illustrated in FIGS. 32 to 35, the drive motor 104 and the tool head 108 are arranged on mutually opposite sides 244, 246 of the longitudinal axis 194 of the tubular bar 110 and in particular, of the longitudinal plane 242. Here too, an advantageous weight distribution of the handheld abrading machine 100 can be obtained.

In all other respects, the eighth embodiment of the handheld abrading machine 100 that is illustrated in FIGS. 32 to 35 corresponds in regard to the construction and functioning thereof with the first embodiment illustrated in FIGS. 1 to 9, and insofar, reference should be made to the previous description thereof.

In the case of the eighth embodiment of the handheld abrading machine 100 illustrated in FIGS. 32 to 35, this too can be developed further by means of particular ones or a plurality of features of the embodiments two to seven.

Figure 36:
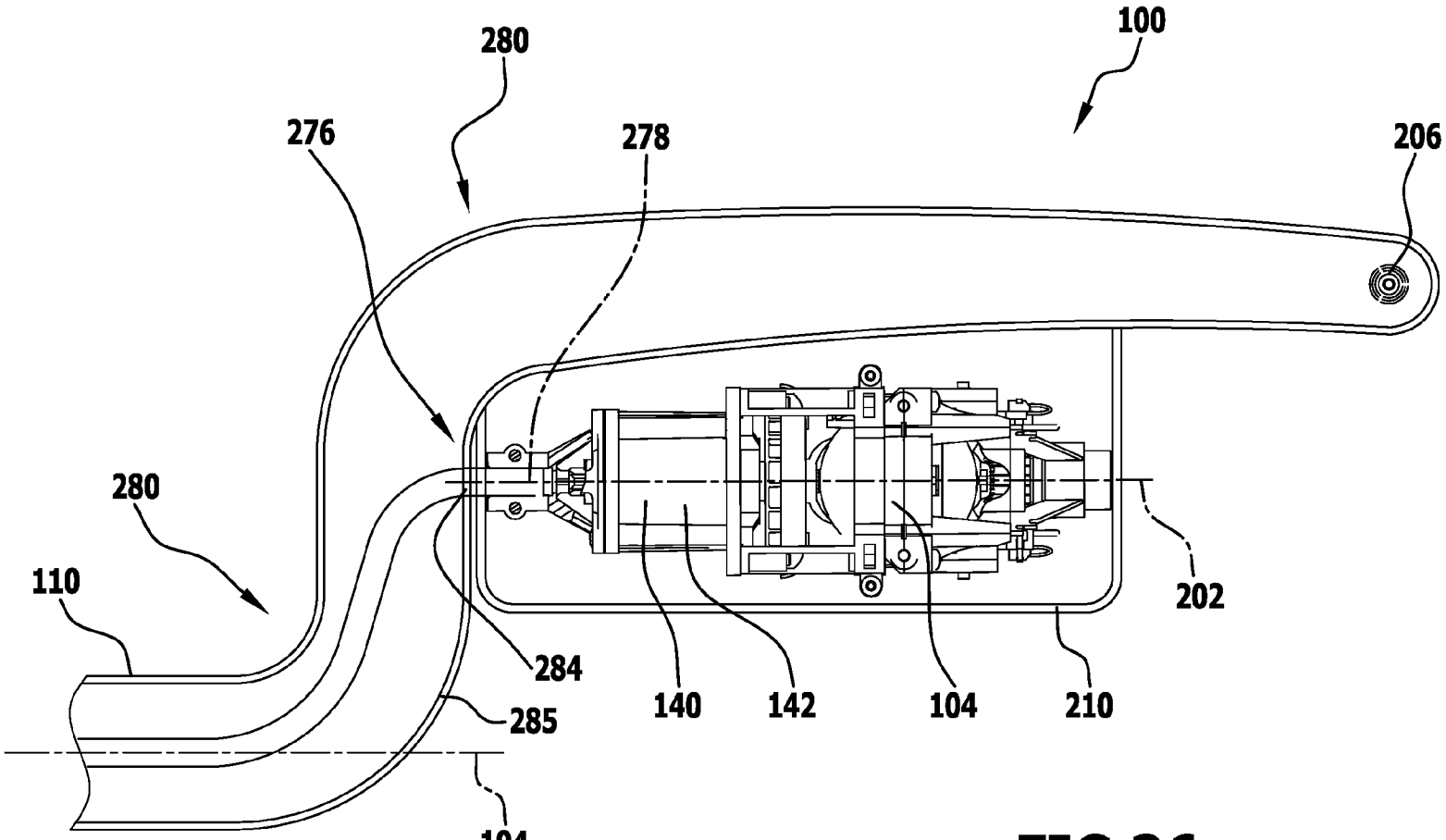
FIG. 36 a schematic illustration of a section of a tubular bar towards the drive motor and the drive motor of a ninth embodiment of an abrading machine, wherein the drive motor is arranged underneath the tubular bar and the tubular bar incorporates two bends.

A ninth embodiment of a handheld abrading machine 100 which is illustrated in FIG. 36 differs from the fifth embodiment illustrated in FIGS. 25 and 26 mainly in that the offsetting device 240 is formed by a flexible end 276 of the transmission shaft 130 towards the drive motor 104.

The end 276 of the transmission shaft 130 towards the drive motor 104 is connected to the drive motor 104 by means of a planetary gear 142 in such a way that a rotational axis 278 of the end 276 of the transmission shaft 130 towards the drive motor 104 and the motor shaft rotational axis 202 are at least approximately identical.

Nevertheless, an offset between the motor shaft rotational axis 202 and the longitudinal axis 194 of the tubular bar 110 is possible due to the flexible arrangement of the transmission shaft 130. Thus, in particular, an offset between the motor shaft rotational axis 202 and a rotational axis 192 of the transmission shaft 130 is also possible in the engagement region 208 of the tubular bar 110.

In the ninth embodiment of the abrading machine 100 illustrated in FIG. 36, the motor shaft rotational axis 202 is offset away from the tool head 108 in a direction running perpendicularly to the longitudinal plane 242.

The motor shaft rotational axis 202 is located opposite the tool head 108 taken with respect to the longitudinal axis 194 of the tubular bar 110.

Nevertheless, the drive motor 104 is arranged on the same side of the tubular bar 110 as the tool head 108 since the tubular bar 110 comprises two bends 280 by means of which the proximal end 114 of the tubular bar 110 towards the drive motor 104 is offset from the longitudinal axis 194 of the tubular bar 110 and in particular, in the engagement region 208 of the tubular bar 110 and is also offset away from the tool head 108.

In all other respects the ninth embodiment of the handheld abrading machine 100 that is illustrated in FIG. 36 corresponds in regard to the construction and functioning thereof with the fifth embodiment illustrated in FIGS. 25 and 26 or with the embodiments one to four illustrated in FIGS. 1 to 24, and insofar, reference should be made to the previous descriptions thereof.

Figure 37:
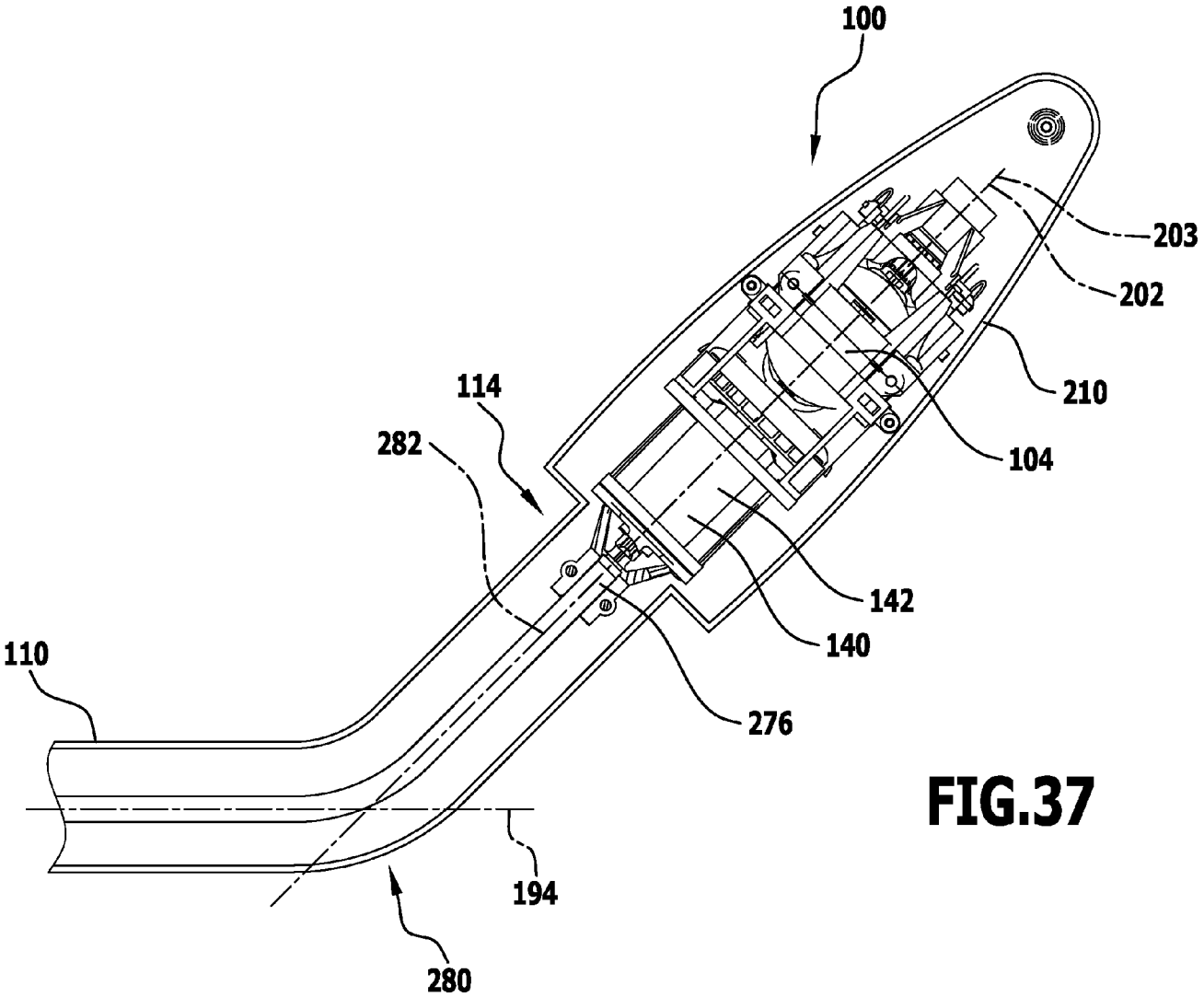
FIG. 37 a schematic illustration corresponding to FIG. 36 of a tenth embodiment of an abrading machine, wherein the drive motor joins an end of the tubular bar and the tubular bar incorporates a bend.

A tenth embodiment of a handheld abrading machine 100 which is illustrated in FIG. 37 differs from the first embodiment illustrated in FIGS. 1 to 9 mainly in that the tubular bar 110 comprises a bend 280, wherein the drive motor 104 directly follows the proximal end 114 of the tubular bar 110 after the bend 280.

The motor shaft rotational axis 202 of the drive motor 104 and an axis of symmetry 282 of the proximal end 114 of the tubular bar 110 are substantially identical.

The motor shaft rotational axis 202 is a motor shaft rotational axis 203 oriented transversely relative to the longitudinal axis 194 of the tubular bar 110.

The bend 280 is formed in such a way that the drive motor 104 is arranged opposite the tool head 108 taken with respect to the longitudinal axis 194 of the tubular bar 110.

Thus, the ninth embodiment of the handheld abrading machine 100 illustrated in FIG. 37 also has an advantageous weight distribution.

In all other respects the tenth embodiment of the handheld abrading machine 100 that is illustrated in FIG. 37 corresponds in regard to the construction and functioning thereof with the first embodiment illustrated in FIGS. 1 to 9, and insofar, reference should be made to the previous description thereof.

As an alternative or in addition thereto, further development of the tenth embodiment of the handheld abrading machine 100 that is illustrated in FIG. 37 may also be effected by means of particular ones or a plurality of the features of the further embodiments.

Figure 38:
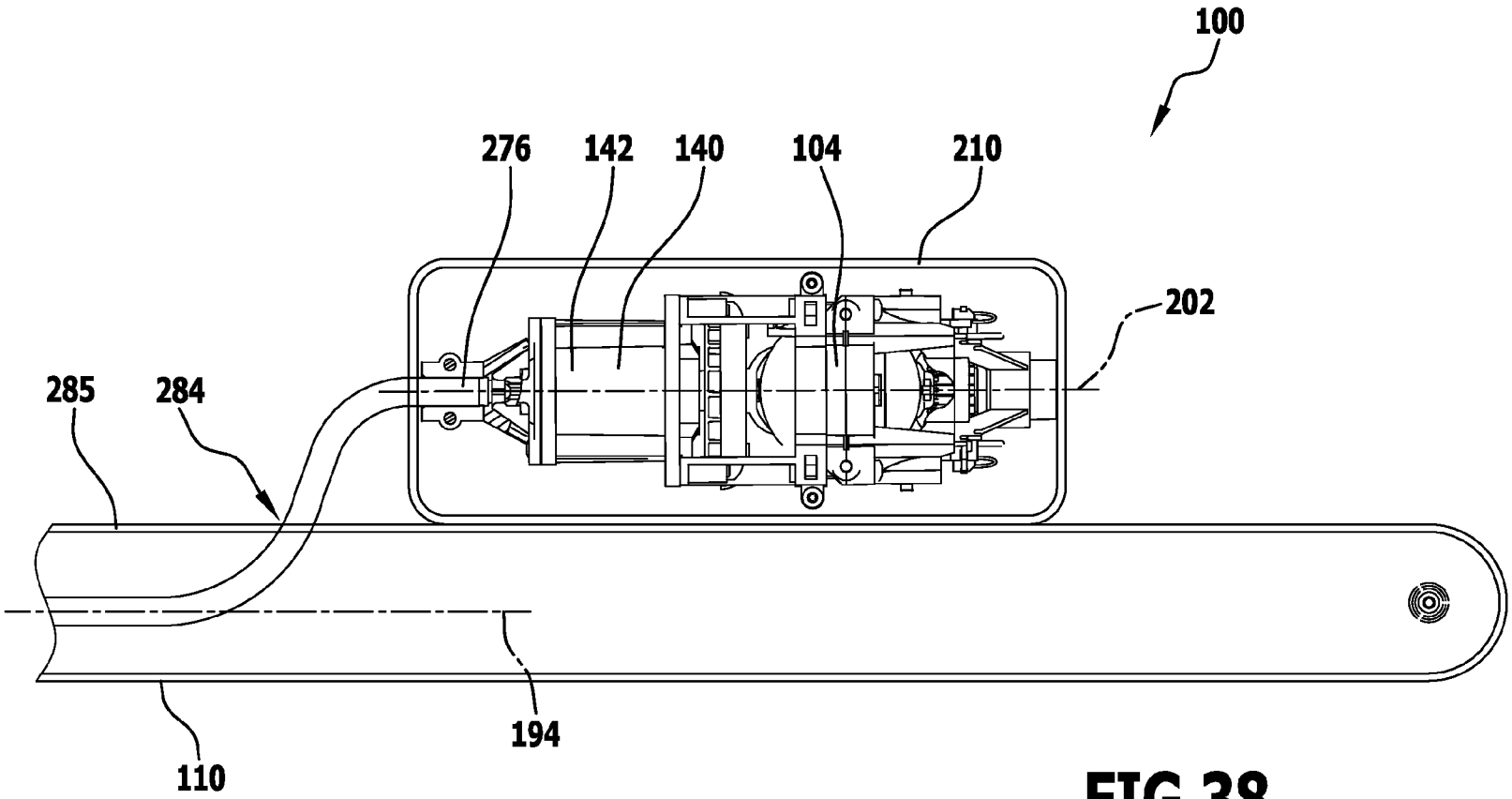
FIG. 38 a schematic illustration corresponding to FIG. 36 of an eleventh embodiment of an abrading machine, wherein the drive motor is arranged above the tubular bar and an offsetting device in the form of a flexible transmission shaft is provided.

An eleventh embodiment of a handheld abrading machine 100 which is illustrated in FIG. 38 differs from the ninth embodiment illustrated in FIG. 36 mainly in that the tubular bar 110 does not comprise a bend 280 at least at its proximal end 114.

The drive motor 104 is located on the opposite side of the tubular bar 110 to the tool head 108.

The transmission shaft 130 is fed into the interior space 262 of the tubular bar 110 through a through-opening 284. For the purposes of protecting the transmission shaft 130 in the region between the housing 210 for the drive motor 104 and the tubular bar 110, provision may be made for a (not illustrated) protective device.

The through-opening 284 is preferably a through-opening 284 which differs from the openings 283 of the tubular bar 110 that form a base area of the tubular bar 110.

In particular, the through-opening 284 is arranged and/or formed in a side wall 285 of the tubular bar 110.

In all other respects, the eleventh embodiment of the handheld abrading machine 100 that is illustrated in FIG. 38 corresponds in regard to the construction and functioning thereof with the ninth embodiment illustrated in FIG. 36 so that reference should be made to the previous description thereof.

The eleventh embodiment of the abrading machine 100 that is illustrated in FIG. 38 can also be further developed by means of particular ones or a plurality of features of the other embodiments.

Figure 39:
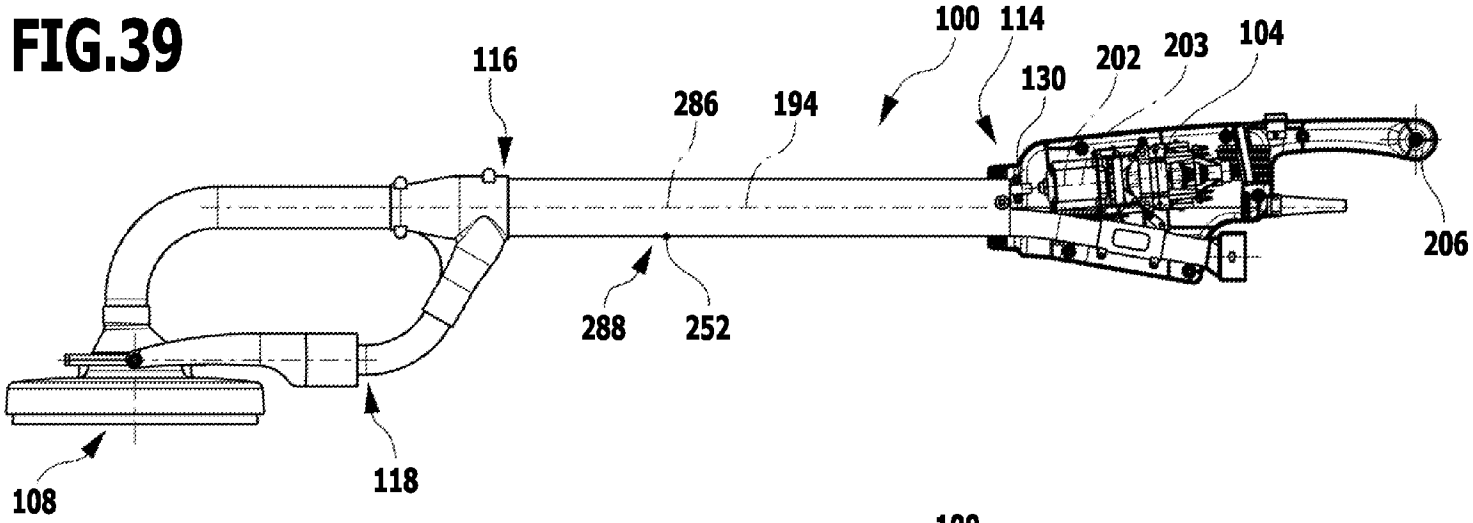
FIG. 39 a partly sectional side view corresponding to FIG. 6 of a twelfth embodiment of an abrading machine, wherein a motor shaft rotational axis of the drive motor of the abrading machine, an axis of symmetry of an end of the tubular bar towards the drive motor and a longitudinal axis of the tubular bar are oriented transversely of each other and the tubular bar extends at least approximately linearly from the drive motor to a flexible tubing element which connects the tubular bar to the tool head.

A twelfth embodiment of a handheld abrading machine 100 which is illustrated in FIG. 39 mainly differs from the eighth embodiment illustrated in FIGS. 32 to 35 in that the interior space part 266 of the tubular bar 110 forming the tubular suction channel section 176*c* comprises a bend 280. The suction channel 172 can thus be passed through underneath the drive motor 104 in space-saving manner. The housing 210 can thereby be formed in a particularly compact manner.

In all other respects, the twelfth embodiment of the handheld abrading machine 100 that is illustrated in FIG. 39 corresponds in regard to the construction and functioning thereof with the eighth embodiment described in FIGS. 32 to 35, and insofar, reference should be made to the previous description thereof.

The twelfth embodiment of the abrading machine 100 that is illustrated in FIG. 39 can also be further developed by means of particular ones or a plurality of features of the other embodiments.

Figure 40:
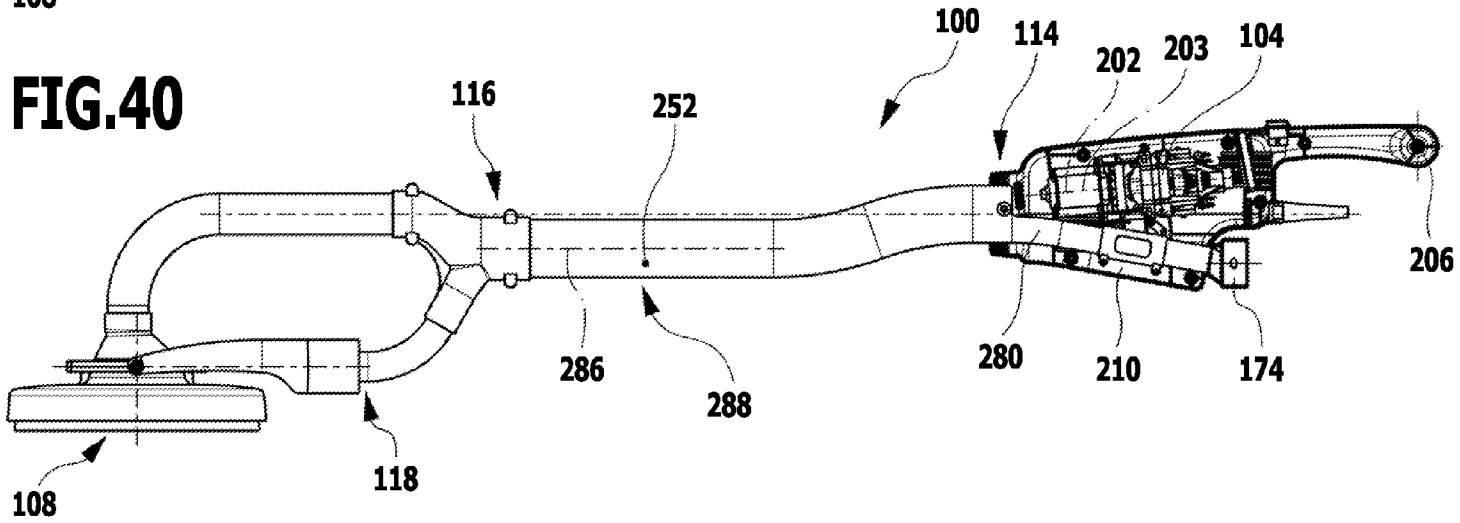
FIG. 40 a partly sectional side view corresponding to FIG. 39 of a thirteenth embodiment of an abrading machine in which the connecting elements between the drive motor and the tool head incorporate at least one bend before and after a central section of the tubular bar taken with respect to a longitudinal axis of the tubular bar.

A thirteenth embodiment of a handheld abrading machine 100 which is illustrated in FIG. 40 differs from the twelfth embodiment illustrated in FIG. 39 mainly in that the tubular bar 110 comprises a plurality of bends 280. The tubular bar 110 thus has a plurality of longitudinal axes 194.

In particular, the tubular bar 110 has a longitudinal axis 286 of a central section 288 of the tubular bar 110.

The central section 288 is, in particular, a central linear section 288 between the drive motor 104 and the tool head 108.

The central section 288 is, in particular, the engagement region 208 of the tubular bar 110 which is gripped by a user when the abrading machine 100 is effecting an abrading action.

In particular, the central section 288 of the tubular bar 110 is that section of the tubular bar 110 in which or close to which the center of gravity 252 of the handheld abrading machine 100 is located.

In all other respects, the thirteenth embodiment of the handheld abrading machine 100 that is illustrated in FIG. 40 corresponds in regard to the construction and functioning thereof with the twelfth embodiment illustrated in FIG. 39, and insofar, reference should be made to the previous description thereof.

The thirteenth embodiment of the abrading machine 100 that is illustrated in FIG. 40 can also be further developed by means of particular ones or a plurality of features of the other embodiments.

Preferred embodiments are the following.

1. A handheld abrading machine (100) comprising a holding device (102) for holding the abrading machine (100), a drive motor (104) and a tool head (108),
   wherein the holding device (102) comprises a substantially tubular bar (110) which has a proximal end (114) and a distal end (116),
   wherein the drive motor (104) is arranged at the proximal end (114),
   wherein the tool head (108) is arranged at the distal end (116),
   wherein the abrading machine (100) comprises a transmission shaft (130) which connects the drive motor (104) to a tool holder (132) of the tool head (108) for transmitting torque thereto and which runs at least in sections thereof within the tubular bar (110).
2. A handheld abrading machine (100) in accordance with embodiment 1, characterized in that the abrading machine (100) comprises a suction device (170) which comprises a suction channel (172) having a substantially ring-shaped or ring-section-shaped suction channel section (176*a*),
   wherein the substantially ring-shaped or ring-section-shaped suction channel section (176*a*) surrounds a coupling device (138) for coupling the transmission shaft (130) to the tool holder (132) at least in sections thereof 3. A handheld abrading machine (100) in accordance with embodiment 2, characterized in that the substantially ring-shaped or ring-section-shaped suction channel section (176*a*) surrounds at least approximately concentrically a gear unit (140) for coupling the transmission shaft (130) to the tool holder (132).
4. A handheld abrading machine (100) in accordance with any of the embodiments 1 to 3, characterized in that the tool holder (132) and an end (144) of the transmission shaft (130) towards the tool holder (132) are connected to one another by means of a planetary gear (142).
5. A handheld abrading machine (100) in accordance with any of the embodiments 1 to 4, characterized in that a substantially ring-shaped or ring-section-shaped suction channel section (176*a*) of a suction channel (172) of a suction device (170), the tool holder (132), an end (144) of the transmission shaft (130) towards the tool holder (132) and/or a hood device (156) for covering the tool holder (132) are arranged such as to be substantially mutually coaxial.
6. A handheld abrading machine (100) in accordance with any of the embodiments 1 to 5, characterized in that the transmission shaft (130) is flexible at least in sections thereof.
7. A handheld abrading machine (100) in accordance with any of the embodiments 1 to 6, characterized in that the tool head (108) is connected to the holding device (102) such as to be pivotal about one or more pivotal axes (120).
8. A handheld abrading machine (100) in accordance with embodiment 7, characterized in that an end (144) of the transmission shaft (130) towards the tool holder (132) is pivotal together with the tool head (108) about one or more pivotal axes (120).
9. A handheld abrading machine (100) in accordance with any of the embodiments 1 to 8, characterized in that the handheld abrading machine (100) comprises two or more gear units (140) for coupling the drive motor (104) to the tool holder (132), wherein at least one respective gear unit (140) is arranged at an end (276) of the transmission shaft (130) towards the drive motor (104) and also at an end (144) of the transmission shaft (130) towards the tool holder (132).
10. A handheld abrading machine (100) in accordance with any of the embodiments 1 to 9, characterized in that the suction channel (172) of the suction device (170) of the handheld abrading machine (100) and the transmission shaft (130) run together at least in sections thereof in a tubing element (112) of the handheld abrading machine (100).
11. A handheld abrading machine (100) in accordance with any of the embodiments 1 to 10, characterized in that the substantially ring-shaped or ring-section-shaped suction channel section (176*a*) is connected in space-fixed manner to the coupling device (138) by means of which the tool holder (132) and an end (144) of the transmission shaft (130) towards the tool holder (132) are connected to one another.
12. A handheld abrading machine (100) in accordance with any of the embodiments 1 to 11, characterized in that the substantially ring-shaped or ring-section-shaped suction channel section (176*a*) is formed at least in sections thereof by a housing (136) of the coupling device (138) for coupling the transmission shaft (130) to the tool holder (132).
13. A handheld abrading machine (100) in accordance with embodiment 12, characterized in that the housing (136) is connected to the holding device (102) in pivotal manner by means of at least one swivel element (122).
14. A handheld abrading machine (100) in accordance with any of the embodiments 1 to 13, characterized in that the substantially ring-shaped or ring-section-shaped suction channel section (176*a*) of the suction channel (172) and a suction channel section (176*c*) of the suction channel (172) running within a tubular bar (110) of the holding device (102) are connected to one another in fluid-conveying manner by means of a flexible suction channel section (176*b*) of the suction channel (172).
15. A handheld abrading machine (100) in accordance with embodiment 14, characterized in that the transmission shaft (130) runs at least in sections thereof within a flexible tubing element (180) comprising and/or forming the flexible suction channel section (176*b*).
16. A handheld abrading machine (100) in accordance with any of the embodiments 1 to 15, characterized in that the tool holder (132) is selectively couplable to the transmission shaft (130) or removable from the transmission shaft (130) by means of a coupling device (138).
17. A handheld abrading machine (100) in accordance with any of the embodiments 1 to 16, characterized in that the tool head (108) comprises a hood device (156) for covering the tool holder (132),
    wherein the hood device (156) comprises a hood element (158) which has a substantially cylindrical hood chamber (160),
    wherein the tool holder (132) together with a tool (106) arranged thereon is arrangeable at least in sections thereof in the hood chamber (160).
18. A handheld abrading machine (100) in accordance with any of the embodiments 1 to 17, characterized in that the hood element (158) comprises a recess (214) in the form of a segment of a cylinder so that a tangent (220) touching an edge (218) of the tool (106) arranged in the tool holder (132) runs substantially in a plane (216) delimiting the recess (214) in the form of a segment of a cylinder.
19. A handheld abrading machine (100) in accordance with any of the embodiments 1 to 18, characterized in that the tool holder (132), the transmission shaft (130) and the hood element (158) are arranged on a central element (134) of the tool head (108) in rotatable manner.
20. A handheld abrading machine (100) in accordance with embodiment 19, characterized in that the tool holder (132), an end (144) of the transmission shaft (130) towards the tool holder (132) and the hood element (158) are arranged on the central element (134) of the tool head (108) such as to be rotatable about at least approximately mutually parallel rotational axes (154).
21. A handheld abrading machine (100) in accordance with either of the embodiments 19 or 20, characterized in that the tool holder (132), an end (144) of the transmission shaft (130) towards the tool holder (132) and the hood element (158) are arranged on the central element (134) of the tool head (108) such as to be rotatable about a common rotational axis (154).
22. A handheld abrading machine (100) in accordance with any of the embodiments 1 to 21, characterized in that a central element (134) of the tool head (108) is connected to the holding device (102) such as to be pivotal about one or more pivotal axes (120).
23. A handheld abrading machine (100) in accordance with any of the embodiments 1 to 22, characterized in that a central element (134) of the tool head (108) is a housing (136) for a coupling device (138) for coupling the transmission shaft (130) to the tool holder (132).
24. A handheld abrading machine (100) in accordance with any of the embodiments 1 to 23, characterized in that the hood device (156) comprises a braking device (222) by means of which an unwanted rotational movement of the hood element (158) is brakable.

25. A handheld abrading machine (100) in accordance with any of the embodiments 1 to 24, characterized in that the hood device (156) comprises a cover element (234) by means of which the recess (214) in the form of a segment of a cylinder in the hood element (158) is coverable.
26. A handheld abrading machine (100) in accordance with embodiment 25, characterized in that the cover element (234) is moveable into a covering position in which the recess (214) in the faint of a segment of a cylinder is covered, and into an open position in which the hood chamber (160) is accessible through the recess (214).
27. A handheld abrading machine (100) in accordance with either of the embodiments 25 or 26, characterized in that the cover element (234) is arranged on the hood element (158) in rotatable, pivotal, hinged and/or releasable manner
28. A handheld abrading machine (100) in accordance with any of the embodiments 25 to 27, characterized in that the cover element (234) is rotatable or pivotal about a pivotal axis (236) which is oriented at least approximately perpendicularly to the rotational axis (154) of the tool holder (132).
29. A handheld abrading machine (100) in accordance with any of the embodiments 25 to 28, characterized in that the cover element (234) is rotatable or pivotal about a rotational axis (154) which is oriented at least approximately parallel to the rotational axis (154) of the tool holder (132).
30. A handheld abrading machine (100) in accordance with any of the embodiments 25 to 29, characterized in that the hood element (158) comprises a sealing device (161) which extends along the periphery of the cylindrical hood chamber (160) at least approximately from one side (232*a*; 232*b*) of the recess (214) in the form of a segment of a cylinder up to the side (232*a*; 232*b*) of the recess (214) in the form of a segment of a cylinder that is located opposite said one side (232*a*; 232*b*).
31. A handheld abrading machine (100) in accordance with embodiment 30, characterized in that the cover element (234) comprises a sealing device (237) which is arranged on the cover element (234) in such a way that, in a covering position of the cover element (234), the sealing device (161) of the hood element (158) and the sealing device (237) of the cover element (234) form a sealing ring (165) which at least approximately completely surrounds the cylindrical hood chamber (160) in annular manner
32. A handheld abrading machine (100) in accordance with any of the embodiments 1 to 31, characterized in that the hood device (156) has one or more contact sections (226), the surfaces (228) of which form a contact surface (230) for the lateral placement of the tool head (108), wherein the contact surface (230) runs at least approximately in the plane (216) which delimits the recess (214) in the form of a segment of a cylinder.
33. A handheld abrading machine (100) in accordance with any of the embodiments 1 to 32, characterized in that the hood element (158) is formed in one-piece manner with at least one contact section (226) of the hood device (156).
34. A handheld abrading machine (100) in accordance with any of the embodiments 1 to 33, characterized in that a motor shaft rotational axis (203) of the drive motor (104) is oriented transversely, and in particular is inclined, relative to a longitudinal axis (194) of the tubular bar (110).
35. A handheld abrading machine (100) in accordance with any of the embodiments 1 to 34, characterized in that the longitudinal axis (194) of the tubular bar (110) is a longitudinal axis (286), an axis of symmetry (198) and/or a mid axis (196) of a central section (288) of the tubular bar (110) between the drive motor (104) and the tool head (108).
36. A handheld abrading machine (100) in accordance with any of the embodiments 1 to 35, characterized in that the longitudinal axis (194) of the tubular bar (110) is a longitudinal axis (286), an axis of symmetry (198) and/or a mid axis (196) of a central linear section (288) of the tubular bar (110) between the drive motor (104) and the tool head (108).
37. A handheld abrading machine (100) in accordance with any of the embodiments 1 to 36, characterized in that the longitudinal axis (194) of the tubular bar (110) is a longitudinal axis (194) of an engagement region (208) of the tubular bar (110) which is gripped by a user when the abrading machine (100) is effecting an abrading action.
38. A handheld abrading machine (100) in accordance with any of the embodiments 1 to 37, characterized in that a center of gravity (248) of the drive motor (104) and a center of gravity (250) of the tool head (108) are located on mutually opposite sides (244; 246) of the longitudinal axis (194) of the tubular bar (110).
39. A handheld abrading machine (100) in accordance with any of the embodiments 1 to 38, characterized in that the tubular bar (110) comprises one or more guide elements (270) for the guidance of the transmission shaft (130).
40. A handheld abrading machine (100) in accordance with any of the embodiments 1 to 39, characterized in that the transmission shaft (130) is flexible at least in sections thereof and runs bent or curved in the tubular bar (110) at least in sections thereof
41. A handheld abrading machine (100) in accordance with any of the embodiments 1 to 40, characterized in that the transmission shaft (130) is fed into the tubular bar (110) at the proximal end (114) of the tubular bar (110) in a direction running transversely to the longitudinal axis (194) of the tubular bar (110).
42. A handheld abrading machine (100) in accordance with any of the embodiments 1 to 41, characterized in that the transmission shaft (130) is fed into the tubular bar (110) at the proximal end (114) of the tubular bar (110) substantially parallel to an axis of symmetry (282) of the proximal end (114) of the tubular bar (110).
43. A handheld abrading machine (100) in accordance with any of the embodiments 1 to 42, characterized in that the proximal end (114) of the tubular bar (110) and/or the distal end (116) of the tubular bar (110) comprises at least one bend (280).
44. A handheld abrading machine (100) in accordance with any of the embodiments 1 to 43, characterized in that the transmission shaft (130) is fed out of the tubular bar (110) at the distal end (116) of the tubular bar (110) in a direction running transversely to the longitudinal axis (194) of the tubular bar (110).
45. A handheld abrading machine (100) in accordance with any of the embodiments 1 to 44, characterized in that the transmission shaft (130) is fed out of the tubular bar (110) at the distal end (116) of the tubular bar (110) substantially parallel to an axis of symmetry (198) of the distal end (116) of the tubular bar (110).
46. A handheld abrading machine (100) in accordance with any of the embodiments 1 to 45, characterized in that the motor shaft rotational axis (202) and a rotational axis (278) of the end (276) of the transmission shaft (130) towards the drive motor (104) are mutually offset.
47. A handheld abrading machine (100) in accordance with any of the embodiments 1 to 46, characterized in that the drive motor (104) and the transmission shaft (130) are connected to one another by means of an offsetting device (240) by means of which a rotational movement of a motor shaft (212) of the drive motor (104) is transferable to an end (276) of the transmission shaft (130) which is towards the drive motor (104) and is offset from the motor shaft (212).

48. A handheld abrading machine (100) in accordance with any of the embodiments 1 to 47, characterized in that the tubular bar (110) comprises a through-opening (284) which differs from openings (283) at the ends (114; 116) of the tubular bar (110) and through which the transmission shaft (130) is fed into an interior space (262) of the tubular bar (110) or is fed out of the interior space (262) of the tubular bar (110).

49. A handheld abrading machine (100) in accordance with any of the embodiments 1 to 48, characterized in that the tubular bar (110) comprises a through-opening (284) which differs from openings (283) at the ends of the tubular bar (110) and by means of which an interior space (262) of the tubular bar (110) serving as a suction channel section (176) of a suction channel (172) of a suction device (170) is connected in fluid-conveying manner to at least one further suction channel section (176) of the suction channel (172) of the suction device (170).

50. A handheld abrading machine (100) in accordance with any of the embodiments 1 to 49, characterized in that the tubular bar (110) comprises an engagement region (208) which is gripped by a user when the abrading machine (100) is effecting an abrading action.

51. A handheld abrading machine (100) in accordance with any of the embodiments 1 to 50, characterized in that a motor shaft rotational axis (202) of the drive motor (104) is oriented substantially parallel to the longitudinal axis (194) of the tubular bar (110).

52. A handheld abrading machine (100) in accordance with any of the embodiments 1 to 51, characterized in that a motor shaft (212) of the drive motor (104) and an end (276) of the transmission shaft (130) towards the drive motor (104) are mutually offset with respect to a direction running perpendicularly to the longitudinal axis (194) of the tubular bar (110) and/or with respect to a direction running parallel to the longitudinal axis (194) of the tubular bar (110).

53. A handheld abrading machine (100) in accordance with any of the embodiments 1 to 52, characterized in that a motor shaft rotational axis (202), a rotational axis (278) of an end (276) of the transmission shaft (130) towards the drive motor (104) and/or a rotational axis of a section of the transmission shaft (130) running in the engagement region (208) of the tubular bar (110) run at least approximately in parallel with each other.

54. A handheld abrading machine (100) in accordance with any of the embodiments 1 to 53, characterized in that a motor shaft rotational axis (202), a rotational axis (278) of an end (144) of the transmission shaft (130) towards the drive motor (104) and/or a rotational axis of a section of the transmission shaft (130) running in the engagement region (208) of the tubular bar (110) are mutually offset with respect to a direction running perpendicularly to the longitudinal axis (194) of the tubular bar (110).

55. A handheld abrading machine (100) in accordance with any of the embodiments 1 to 54, characterized in that an offsetting device (240) comprises a gear wheel device (256) for the transmission of the rotational movement.

56. A handheld abrading machine (100) in accordance with any of the embodiments 1 to 55, characterized in that an offsetting device (240) comprises a toothed belt device (254) for the transmission of the rotational movement.

57. A handheld abrading machine (100) in accordance with any of the embodiments 1 to 56, characterized in that a motor shaft (212) of the drive motor (104) and an end (276) of the transmission shaft (130) towards the drive motor (104) are arranged at least approximately coaxially with respect to each other.

58. A handheld abrading machine (100) in accordance with any of the embodiments 1 to 57, characterized in that a motor shaft (212) of the drive motor (104) and a section of the transmission shaft (130) running in the engagement region (208) of the tubular bar (110) are arranged such that they are mutually offset with respect to a direction running perpendicularly to the longitudinal axis (194) of the tubular bar (110).

59. A handheld abrading machine (100) in accordance with embodiment 58, characterized in that the motor shaft (212) of the drive motor (104) and the section of the transmission shaft (130) running in the engagement region (208) of the tubular bar (110) are connected to one another by means of a flexible section of the transmission shaft (130).

LIST OF REFERENCE SYMBOLS

100 abrading machine
102 holding device
104 drive motor
106 tool
108 tool head
110 tubular bar
112 tubing element
114 proximal end
116 distal end
118 swivel device
120 pivotal axis
120*a* first pivotal axis
120*b* second pivotal axis
122 swivel element
124 swivel fork
126 swivel ring
128 attachment element
129 attachment arm
130 transmission shaft
130*a* first part of the transmission shaft
130*b* second part of the transmission shaft
132 tool holder
134 central element
136 housing
138 coupling device
140 gear unit
142 planetary gear
143 central wheel (sun wheel)
144 end of the transmission shaft 130 towards the tool holder 132
145 outer wheel (crown wheel)
146 drive shaft
147 planet wheel
148 tool holder shaft
149 planet wheel carrier
150 releasable connecting device
152 output shaft
154 rotational axis
156 hood device
158 hood element
160 hood chamber
161 sealing device
162 brush device
164 peripheral direction
165 sealing ring
166 brush collar

168 axis of symmetry
170 suction device
172 suction channel
174 connector device
176 suction channel section
176*a* ring-shaped or ring-section-shaped suction channel section
176*b* flexible suction channel section
176*c* tubular suction channel section
178 transition section
180 flexible tubing element
182 fork-piece
184 telescopic device
186 outer part
188 inner part
190 extension direction
192 transmission shaft rotational axis
194 longitudinal axis of the tubular bar 110
196 mid axis of the tubular bar 110
198 axis of symmetry of the tubular bar 110
200 end of the tubular bar 110 towards the drive motor 104
202 motor shaft rotational axis
203 motor shaft rotational axis
204 locking device
206 handle element
208 engagement region
210 housing
212 motor shaft
214 recess
216 plane
218 edge
220 tangent
222 braking device
224 contact element
226 contact section
228 surface
230 contact surface
232*a* side
232*b* side
234 covering element
236 pivotal axis
237 sealing device
238 brush device
240 offsetting device
242 longitudinal plane
244 motor side
246 tool side
248 center of gravity of the drive motor 104
250 center of gravity of the tool head 108
252 center of gravity of the abrading machine 100
254 toothed belt device
256 gear wheel device
260 end
262 interior space
264 partition wall
266 interior space part
268 interior space part
270 guide element
272 guide channel
274 groove
276 end of the transmission shaft 130 towards the drive motor 104
278 rotational axis
280 bend
282 axis of symmetry
283 opening
284 through-opening
285 side wall
286 longitudinal axis
288 central section

The invention claimed is:

1. A handheld abrading machine comprising a holding device for holding the abrading machine, a drive motor and a tool head, wherein the holding device comprises a substantially tubular bar which has a proximal end and a distal end, wherein the drive motor is arranged at the proximal end, wherein the tool head is arranged at the distal end, wherein the abrading machine comprises a transmission shaft which connects the drive motor to a tool holder of the tool head for transmitting torque thereto and which runs at least in sections thereof within the tubular bar, wherein the tool head comprises a hood device for covering the tool holder, wherein the hood device comprises a hood element which has a substantially cylindrical hood chamber, wherein the tool holder together with a tool arranged thereon is arrangeable, at least in sections thereof, in the hood chamber, wherein the hood element comprises a recess in the form of a segment of a cylinder so that a tangent touching an edge of a tool arranged in the tool holder runs substantially in a plane delimiting the recess in the form of a segment of a cylinder, wherein the tool holder, an end of the transmission shaft towards the tool holder and the hood element are arranged on a central element of the tool head such as to be rotatable about at least approximately mutually parallel rotational axes, and wherein a substantially ring-shaped or ring-section-shaped suction channel section of a suction channel of a suction device of the abrading machine is formed by the central element.

2. The handheld abrading machine in accordance with claim 1, wherein the tool holder, an end of the transmission shaft towards the tool holder and the hood element are arranged on the central element of the tool head such as to be rotatable about a common rotational axis.

3. The handheld abrading machine in accordance with claim 1, wherein the central element of the tool head is connected to the holding device such as to be pivotal about one or more pivotal axes.

4. The handheld abrading machine in accordance with claim 1, wherein the central element of the tool head is a housing for a coupling device for coupling the transmission shaft to the tool holder.

5. The handheld abrading machine in accordance with claim 1, wherein the hood device comprises a braking device by means of which an unwanted rotational movement of the hood element is brakable.

6. The handheld abrading machine in accordance with claim 1, wherein the hood device comprises a cover element by means of which the recess in the form of a segment of a cylinder in the hood element is coverable.

7. The handheld abrading machine in accordance with claim 6, wherein the cover element is moveable into a covering position in which the recess in the form of a segment of a cylinder is covered, and into an open position in which the hood chamber is accessible through the recess.

8. The handheld abrading machine in accordance with claim 6, wherein the cover element is arranged on the element in at least one of a rotatable manner, a pivotal manner, a hinged manner or a releasable manner.

9. The handheld abrading machine in accordance with claim 6, wherein the cover element is rotatable or pivotal about a pivotal axis which is oriented at least approximately perpendicularly to the rotational axis of the tool holder.

10. The handheld abrading machine in accordance with claim 6, wherein the cover element is rotatable or pivotal about a rotational axis which is oriented at least approximately parallel to the rotational axis of the tool holder.

11. The handheld abrading machine in accordance with claim 6, wherein the hood element comprises a sealing device which extends along the periphery of the cylindrical hood chamber at least approximately from one side of the recess in the form of a segment of a cylinder up to a side of the recess in the form of a segment of a cylinder that is located opposite said one side, and wherein the cover element comprises a sealing device which is arranged on the cover element in such a way that, in a covering position of the cover element, the sealing device of the hood element and the sealing device of the cover element form a sealing ring which at least approximately completely surrounds the cylindrical hood chamber in an annular manner.

12. The handheld abrading machine in accordance with claim 1, wherein the hood device comprises one or more contact sections, surfaces of which form a contact surface for the lateral placement of the tool head, wherein the contact surface runs at least approximately in the plane which delimits the recess in the form of a segment of a cylinder.

13. The handheld abrading machine in accordance with claim 1, wherein the hood element is formed in a one-piece manner with at least one contact section of the hood device.

* * * * *